US006927737B2

(12) United States Patent
Inoue

(10) Patent No.: US 6,927,737 B2
(45) Date of Patent: Aug. 9, 2005

(54) COMPOSITE ANTENNA

(75) Inventor: Jinichi Inoue, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/466,863

(22) PCT Filed: Oct. 29, 2002

(86) PCT No.: PCT/JP02/11209

§ 371 (c)(1),
(2), (4) Date: Jul. 15, 2003

(87) PCT Pub. No.: WO03/043130

PCT Pub. Date: May 22, 2003

(65) Prior Publication Data

US 2004/0051675 A1 Mar. 18, 2004

(30) Foreign Application Priority Data

Nov. 16, 2001 (JP) ..... 2001-352074

(51) Int. Cl.[7] ..... H01Q 1/30
(52) U.S. Cl. ..... 343/727
(58) Field of Search ..... 343/727, 726, 343/728, 729, 730, 895, 985

(56) References Cited

U.S. PATENT DOCUMENTS

| | | | | |
|---|---|---|---|---|
| 3,771,158 A | * | 11/1973 | Hatcher | 343/728 |
| 5,245,745 A | * | 9/1993 | Jensen et al. | 29/600 |
| 5,952,971 A | * | 9/1999 | Strickland | 343/700 MS |
| 5,999,132 A | * | 12/1999 | Kitchener et al. | 343/702 |
| 6,720,932 B1 | * | 4/2004 | Flynn et al. | 343/786 |

FOREIGN PATENT DOCUMENTS

| | | |
|---|---|---|
| JP | 02-214304 | 8/1990 |
| JP | 03-73018 | 7/1991 |
| JP | 06-310930 | 11/1994 |

OTHER PUBLICATIONS

H. Nakano, et al., "A Low–Profile Conical Beam Loop Antenna with an Electromagnetically Coupled Feed System," IEEE Transactions on Antennas and Propagation, vol. 48, No. 12 Dec. 2000 pp. 1864–1866.

T. Hikokubo, et al., "A Study on Dual–resonant Antenna for Wireless Multi–Terminal (B–1–174)," Electronic Information Communication Institute General Meeting 2001 p.192.

* cited by examiner

*Primary Examiner*—Don Wong
*Assistant Examiner*—Huedung X. Cao
(74) *Attorney, Agent, or Firm*—Kirk Hahn

(57) ABSTRACT

An object of the present invention is a small composite antenna that is capable of operating in a plurality of different frequency bands. A first antenna 2 constituting a GPS circularly polarized loop antenna is formed on a dielectric substrate 10. A second antenna 3 constituting an ETC square patch antenna is formed on substantially the same axis as the first antenna 2. An earth pattern is formed in the underside of the dielectric substrate 10, and a recess in whose bottom face an earth pattern is formed so as to lie opposite the second antenna 3 is provided. An arc-shaped feed pattern 4 is electromagnetically coupled to the first antenna 2 so as to supply electricity thereto, whereby this antenna is made to operate as a right-handed circularly polarized antenna. Electricity is supplied by a coaxial cable to the second antenna 3 to cause same to operate as a right-handed circularly polarized antenna.

33 Claims, 23 Drawing Sheets cross-section along the line A-A cross-section along the line B-B plane $\phi$ =0° plane $\phi$ =90° plane $\phi$ =0° plane $\phi$ =90° plane $\phi$ =0° plane $\phi$ =90° cross-section along the line A-A cross-section along the line B-B cross-section along the line A-A cross-section along the line B-B plane $\phi = 0°$ plane $\phi = 90°$ plane $\phi$ =0° plane $\phi$ =90° plane $\phi$ =0° plane $\phi$ =90° plane $\phi$ =0° plane $\phi$ =90°

COMPOSITE ANTENNA

This application is the U.S. National Phase under 35 U.S.C. §371 of International Application PCT/JP02/11209, filed Oct. 29, 2002, which claims priority of Japanese Patent Application No. 2001-352074, filed Nov. 16, 2001. The International Application was published under PCT Article 21(2) in a language other than English.

TECHNICAL FIELD

The present invention relates to a composite antenna in which an antenna which operates in a first frequency band and an antenna which operates in a second frequency band which is lower than the first frequency band are formed on the same substrate.

BACKGROUND ART

The short range communication system known as DSRC (Dedicated Short Range Communication) is known. DSRC is a wireless communication system with a radio wave range from a few meters to several tens of meters, and is used in ETC (Electronic Toll Collection Systems), and ITS (Intelligent Transport Systems). ETC is a system in which communications take place between antennae installed on gates and on-board equipment mounted in vehicles and charges are paid automatically when vehicles pass charge points on highways and so forth. When ETC is adopted, there is no need to stop at the charge points and hence the time required for vehicles to pass gates is dramatically reduced. Such a system therefore enables traffic congestion in the vicinity of the charge points to be alleviated and exhaust gases to be reduced.

Further, ITS is a traffic system which fuses a system enabling greater vehicle intelligence such as car navigation systems (referred to as 'Car Navigation System' hereinafter) with a system enabling superior roadway intelligence such as area traffic control systems. For example, Car Navigation System include systems permitting a hookup with a VICS (Vehicle Information and Communication System). When ITS is used in such a case, general route information gathered by the police and highway information which is collected by the Tokyo Expressway Public Corporation and the Japan Highway Public Corporation is edited and transmitted by a VICS center. Then, when this information is received by a Car Navigation System, a route such as one enabling traffic congestion to be avoided can be sought and displayed on a monitor.

Further, where DSRC is concerned, information is transmitted in this way from wireless communication equipment which is provided at the side of the roadway and in parking facilities and so forth. A DSRC antenna enabling radio waves transmitted from the wireless communication equipment to be received is mounted in a vehicle fitted with a Car Navigation System. DSRC uses the 5.8 GHz band. Also, a GPS antenna is required for a Car Navigation System and a GPS antenna is therefore installed in the vehicle. The GPS uses the 1.5 GHz band. Further, in order to hook up the Car Navigation System with the VICS, a VICS antenna is necessary and hence a VICS antenna is mounted in the vehicle. The VICS uses the 2.5 GHz band.

Thus, because the respective usage frequency bands of the DSRC, GPS and VICS are different, the corresponding antennae must be installed in the vehicle. There is therefore the problem that a plurality of antennae is required, same occupying a broad mount area, and the work involved in mounting a plurality of antennae is complicated.

An object of the present invention is therefore to provide a small composite antenna that is capable of operating in a plurality of different frequency bands.

DISCLOSURE OF THE INVENTION

In order to achieve the above object, a first composite antenna of the present invention comprises: a patch antenna which operates in a first frequency band and which is formed substantially in the center of a dielectric substrate; and a loop antenna which operates in a second frequency band that is lower than the first frequency band and which is formed on the dielectric substrate so as to surround the patch antenna, characterized in that a first earth pattern for the loop antenna is formed in the underside of the dielectric substrate, a recess being formed substantially in the center thereof; and a pattern formed in the bottom face of the recess constitutes a second earth pattern for the patch antenna.

Further, in the case of the first composite antenna of the present invention, a constitution is possible in which the patch antenna and the loop antenna are formed on substantially the same axis; the patch antenna are constituted as a circularly polarized antenna by forming a pair of opposing degeneracy isolation elements on the patch antenna; and the loop antenna are constituted as a circularly polarized antenna by forming a pair of opposing perturbation elements on the loop antenna.

In addition, in the case of the first composite antenna of the present invention, a constitution is possible in which the dielectric substrate is formed by combining a plurality of print substrates, respective patterns for the patch antenna and the loop antenna being formed in the upper surface of a print substrate that lies uppermost, the second earth pattern being formed in the underside of this substrate so as to lie opposite the patch antenna; a through-hole for the formation of the recess is formed substantially in the center of an intermediate print substrate, a feed pattern which is electromagnetically coupled to the loop antenna being formed in the upper surface of the intermediate print substrate; a through-hole for the formation of the recess is formed substantially in the center of a print substrate that lies lowermost, the first earth pattern being formed in the underside of this substrate.

Furthermore, in the case of the first composite antenna of the present invention, a constitution is possible in which a pattern that connects the second earth pattern and the first earth pattern is formed in the circumferential wall face of the recess.

Next, a second composite antenna of the present invention that makes it possible to achieve the above object comprises: a patch antenna which operates in a first frequency band and which is formed in the bottom face of a recess provided substantially in the center of a dielectric substrate; and a loop antenna which operates in a second frequency band that is lower than the first frequency band and which is formed on the dielectric substrate so as to surround the patch antenna, characterized in that an earth pattern is formed in the underside of the dielectric substrate.

Further, in the case of the second composite antenna of the present invention, a constitution is possible in which the patch antenna and the loop antenna are formed on substantially the same axis; the patch antenna is constituted as a circularly polarized antenna by forming a pair of opposing degeneracy isolation elements on the patch antenna; and the loop antenna is constituted as a circularly polarized antenna by forming a pair of opposing perturbation elements on the loop antenna.

In addition, in the case of the second composite antenna of the present invention, a constitution is possible in which the dielectric substrate is formed by combining a plurality of print substrates; a through-hole for the formation of the recess is formed substantially in the center of a print substrate that lies uppermost, a pattern for the loop antenna being formed in the upper surface of this substrate; a through-hole for the formation of the recess is formed substantially in the center of an intermediate print substrate, a feed pattern which is electromagnetically coupled to the loop antenna being formed in the upper surface of the intermediate print substrate; a pattern for the patch antenna is formed in the upper surface of a print substrate that lies lowermost, the earth pattern being formed in the underside of this substrate.

Next, a third composite antenna of the present invention that makes it possible to achieve the above object comprises: a patch antenna which operates in a first frequency band and which is formed in the bottom face of a first recess provided substantially in the center of a dielectric substrate; and a loop antenna which operates in a second frequency band that is lower than the first frequency band and which is formed on the dielectric substrate so as to surround the patch antenna, characterized in that a first earth pattern for the loop antenna is formed in the underside of the dielectric substrate, a second recess being formed substantially in the center thereof; and a pattern formed in the bottom face of the second recess constitutes a second earth pattern for the patch antenna.

Further, in the case of the third composite antenna of the present invention, a constitution is possible in which the patch antenna and the loop antenna are formed on substantially the same axis; the patch antenna is constituted as a circularly polarized antenna by forming a pair of opposing degeneracy isolation elements on the patch antenna; and the loop antenna is constituted as a circularly polarized antenna by forming a pair of opposing perturbation elements on the loop antenna.

In addition, in the case of the third composite antenna of the present invention, a constitution is possible in which the dielectric substrate is formed by combining a plurality of print substrates; a through-hole for the formation of the first recess is formed substantially in the center of a print substrate that lies uppermost, a pattern for the loop antenna being formed in the upper surface of this substrate; a through-hole for the formation of the first recess is formed substantially in the center of a first intermediate print substrate, a feed pattern which is electromagnetically coupled to the loop antenna being formed in the upper surface of the first intermediate print substrate; a pattern for the patch antenna is formed in the upper surface of a second intermediate print substrate, the second earth pattern being formed in the underside of this substrate so as to lie opposite the patch antenna; and a through-hole for the formation of the second recess is formed substantially in the center of a print substrate that lies lowermost, the first earth pattern being formed in the underside of this substrate.

Furthermore, in the case of the third composite antenna of the present invention, a constitution is possible in which a pattern that connects the second earth pattern and the first earth pattern is formed in the circumferential wall face of the second recess.

Also, in the case of the first to third composite antennae of the present invention, a constitution is possible in which a second loop antenna which operates in the first frequency band and which comprises perturbation elements is formed in place of the patch antenna.

In addition, in the case of the first to third composite antennae of the present invention, a constitution is possible in which a spiral antenna which operates in the first frequency band is formed in place of the patch antenna.

Next, a fourth composite antenna of the present invention that makes it possible to achieve the above object comprises: a helical antenna which operates in a first frequency band and which is provided substantially in the center of a dielectric substrate; and a circularly polarized loop antenna which operates in a second frequency band that is lower than the first frequency band and which is formed on the dielectric substrate so as to surround the helical antenna, characterized in that an earth pattern is formed in the underside of the dielectric substrate.

According to the present invention which is thus constituted, because a loop antenna which operates in a second frequency band is formed on a dielectric substrate so as to surround a patch antenna which operates in a first frequency band, a small composite antenna which operates in two different frequency bands can be obtained. Accordingly, because, according to the present invention, a space in the loop antenna which operates in the second frequency band is used to form a patch antenna which operates in the first frequency band, a small composite antenna can be obtained, and the mount area thereof can be reduced and handling thereof facilitated.

Further, because the loop antenna and the patch antenna are provided on substantially the same axis, it is possible to inhibit the mutual influence of the antennae. In addition, when the patch antenna is provided with degeneracy isolation elements, a DSRC circularly polarized antenna for ETC and the like can be implemented, and, by providing the loop antenna with perturbation elements to constitute a circularly polarized antenna, a GPS antenna can be produced.

BRIEF DESCRIPTION OF THE DRAWINGS

FIG. 51(*b*) is a planar view showing the constitution of a modified example of the composite antenna according to the second embodiment of the present invention; and FIG. 51(*c*) is a planar view showing the constitution of a modified example of the composite antenna according to the third embodiment of the present invention.

BEST MODE FOR CARRYING OUT THE INVENTION

Figure 1:
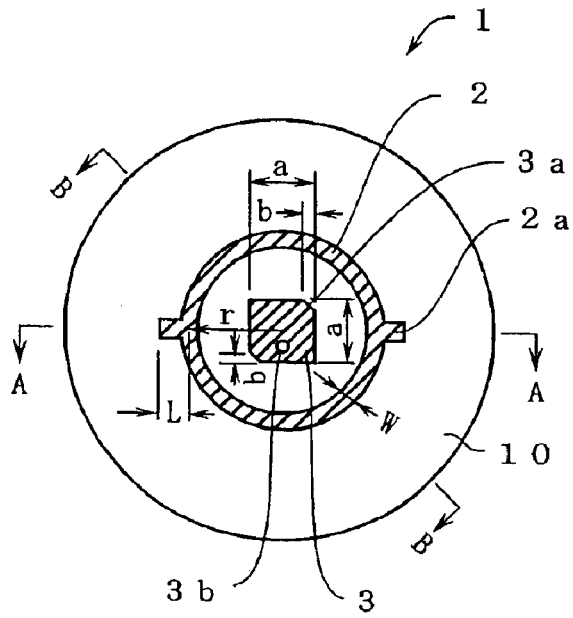
FIG. 1 is a planar view of the constitution of the composite antenna according to a first embodiment of the present invention.
Figure 2:
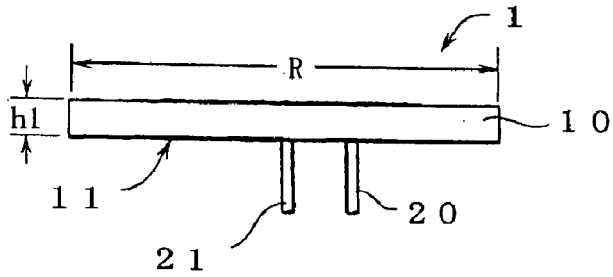
FIG. 2 is a side view of the constitution of the composite antenna according to the first embodiment of the present invention.
Figure 3:
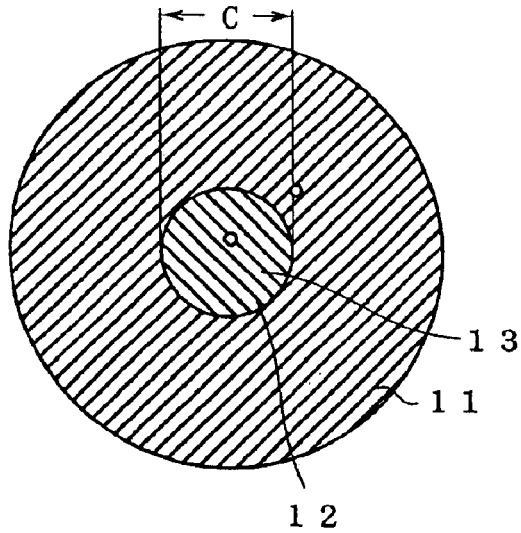
FIG. 3 is a rear view of the constitution of the composite antenna according to the first embodiment of the present invention.
Figure 4:
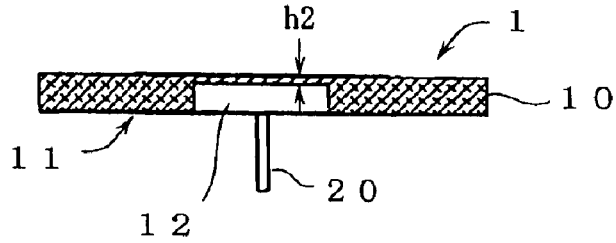
FIG. 4 is a cross-sectional view along the line A—A of the constitution of the composite antenna according to the first embodiment of the present invention.
Figure 5:
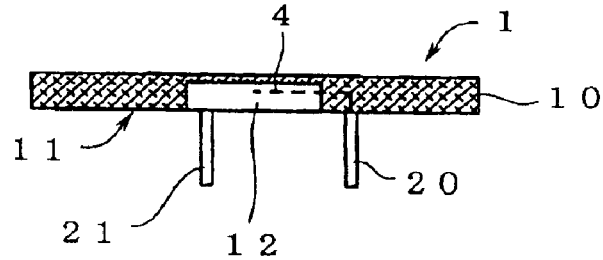
FIG. 5 is a cross-sectional view along the line B—B of the constitution of the composite antenna according to the first embodiment of the present invention.
Figure 6:
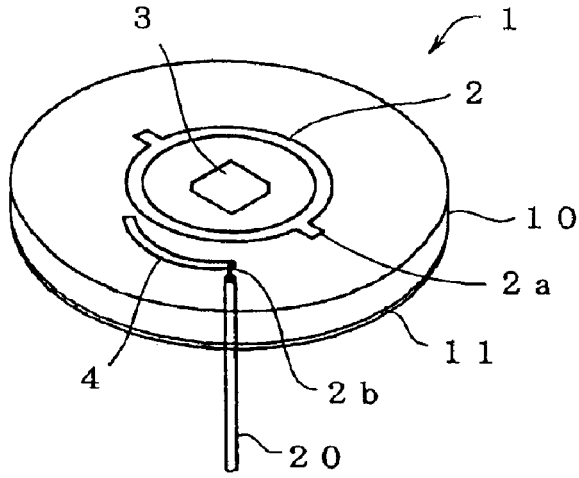
FIG. 6 is a perspective view of an outline constitution of the composite antenna according to the first embodiment of the present invention.
Figure 7:
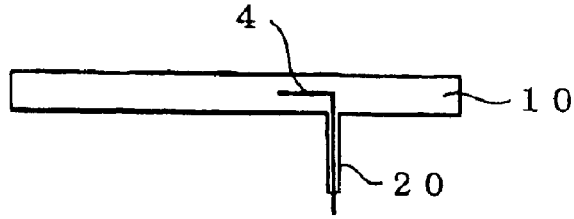
FIG. 7 is a side view of an outline constitution of the composite antenna according to the first embodiment of the present invention.

The constitution of the composite antenna according to the first embodiment of the present invention is shown in FIGS. 1 through 7, where FIG. 1 is a planar view of the composite antenna according to the present invention; FIG. 2 is a side view thereof; FIG. 3 is a rear view thereof; FIG. 4 is a cross-sectional view thereof along the line A—A; FIG. 5 is a cross-sectional view thereof along the line B—B; FIG. 6 is a perspective view showing an outline constitution thereof; and FIG. 7 is a side view showing an outline constitution thereof.

The first composite antenna 1 shown in FIGS. 1 to 7 is a two-frequency composite antenna and is constituted to operate as a 5.8 GHz-band DSRC antenna for ETC or similar and as a 1.5 GHz-band GPS antenna, for example. A first antenna 2 is formed by a print pattern in the upper surface of a circular dielectric substrate 10 which constitutes the composite antenna 1. The first antenna 2 is a loop antenna, and is constituted as a circularly polarized antenna as a result of being formed having a pair of perturbation elements 2*a* that lie opposite each other in an outward direction. Further, a second antenna 3 is formed by a print pattern to be situated substantially in the center of the first antenna 2 so as to lie substantially coaxially therewith. The second antenna 3 is a square patch antenna and is constituted as a circularly polarized antenna as a result of being formed with a top having a pair of opposing degeneracy isolation elements 3*a*.

A first earth pattern 11 is formed over the whole of the underside of the dielectric substrate 10. Further, a recess 12 of a predetermined depth is formed substantially in the center of the underside of the dielectric substrate 10 and then a circular second earth pattern 13 is formed in the bottom face of the recess 12. The first antenna 2 is constituted to operate as a right-handed circularly polarized antenna as a result of electricity being supplied from an arc-shaped feed pattern 4 which is disposed so as to be electromagnetically coupled to this first antenna. This feed pattern 4 is disposed so as to be embedded within the dielectric substrate 10, this dielectric substrate 10 being shown as a transparent substrate in FIGS. 6 and 7. The core of a first feed line 20 which is a coaxial cable is connected to a first feed point 2*b* of the feed pattern 4, and the shield of the first feed line 20 is connected to the first earth pattern 11. Further, because electricity is supplied by connecting the core of a second feed line 21 which is a coaxial cable to the second feed point 3*b* of the second antenna 3, the second antenna 3 is made to operate as a right-handed circularly polarized antenna. Further, the shield of the second feed line 21 is connected to the second earth pattern 13 formed in the bottom face of the recess 10.

The recess 12 is provided in the bottom face of the dielectric substrate 10 in order to reduce the gap h2 between the second antenna 3 and the second earth pattern 13. The gap h2 is reduced in this way in order that the gap from the earth pattern of the patch antenna should be small in comparison with the loop antenna. The dielectric substrate 10 can be a Teflon substrate or another resin substrate and may be a substrate comprising a layer consisting substantially of air such as a honeycomb core substrate. Further, by connecting the second earth pattern 13 and the first earth pattern 11 by forming an electrically conductive film in the circumferential wall face of the recess 12, leakage of electromagnetic waves from the circumferential wall face of the recess 12 may be prevented.

Figure 8:
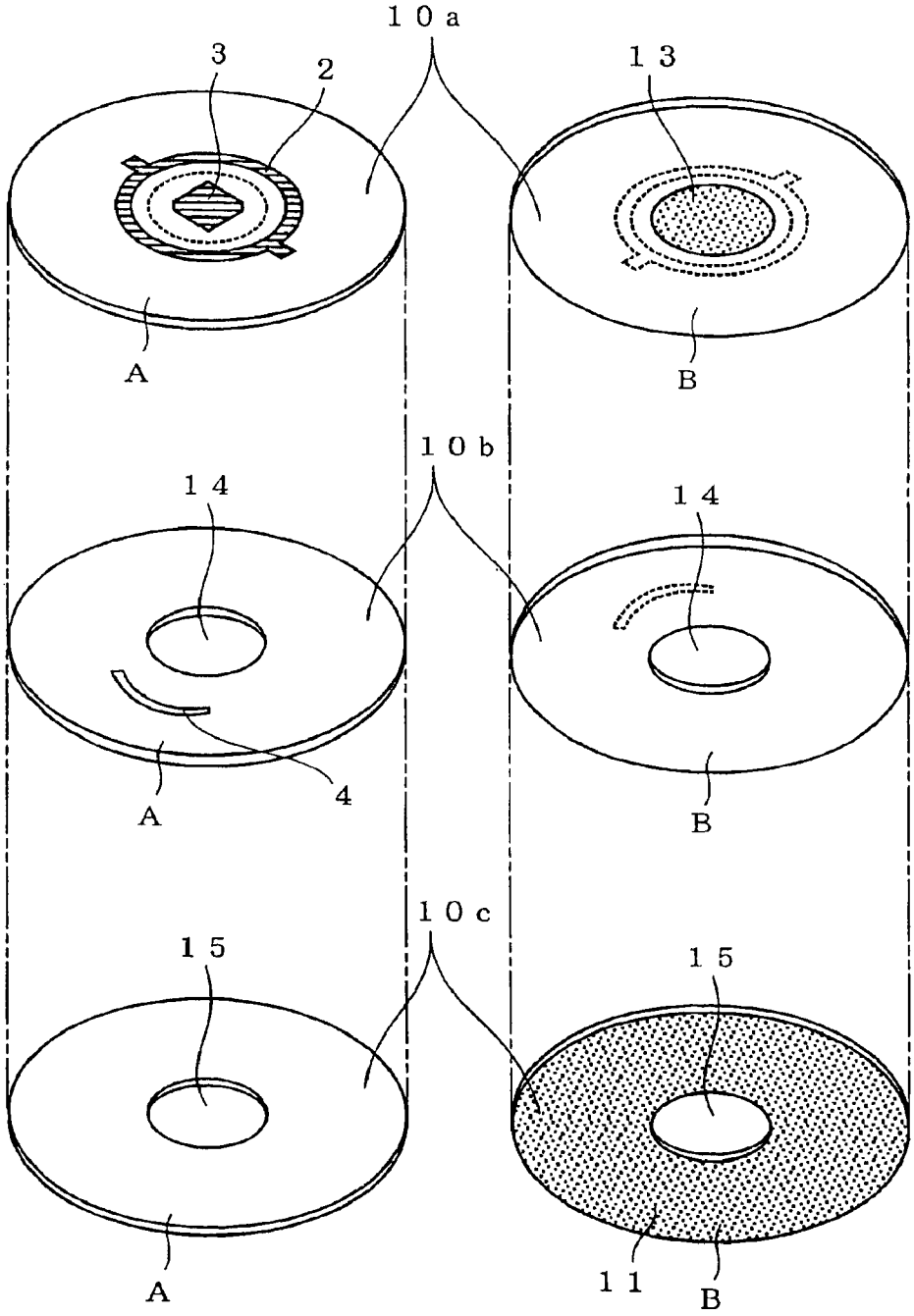
FIG. 8 is a development drawing that serves to illustrate the method for creating the composite antenna according to the first embodiment of the present invention.

Next, an example of a method for creating the composite antenna 1 according to the first embodiment of the present invention is illustrated in FIG. 8.

According to this creation method, the composite antenna 1 is created by combining three dielectric substrates constituted by print substrates which are circular and of substantially equal diameter. A pattern for the second antenna 3 is formed substantially in the center of the upper surface A of a first dielectric substrate 10*a* which lies uppermost, and a pattern for the first antenna 2 is formed on substantially the same axis so as to surround the second antenna 3. Further, the circular second earth pattern 13 is formed substantially in the center of the underside B of this substrate. A through-hole 14 for the formation of the recess 12 is formed substantially in the center of a second intermediate dielectric substrate 10*b*, and an arc-shaped feed pattern 4 which is electromagnetically coupled to the first antenna 2 is formed in the upper surface A of this intermediate substrate. An electrically conductive film may be formed on the circumferential side face of the through-hole 14. In addition, a through-hole 15 for the formation of the recess 12 is formed substantially in the center of a third dielectric substrate 10*c* that lies lowermost, a first earth pattern 11 being formed in the underside B of this substrate. An electrically conductive film may be formed on the circumferential side face of the through-hole 15. The first composite antenna 1 according to the present invention can be created by aligning and combining these three dielectric substrates 10*a*, 10*b* and 10*c*. The patterns of the dielectric substrates 10*a*, 10*b* and 10*c* are formed by plating the substrates with copper foil, or an electrically conductive material, or the like.

The first composite antenna 1 according to the present invention comprises a first antenna 2 which is a right-handed circularly polarized loop antenna that operates in the GPS band and which is formed on the dielectric substrate 10. Because this antenna is a loop antenna, the space therein can be utilized. Therefore, in the case of the first composite antenna 1 according to the present invention, a second antenna 3 that is a square patch antenna which operates in the ETC frequency band is disposed in the space in the first antenna 2 so as to lie on substantially the same axis as the first antenna 2. A small composite antenna which is capable of operating in two different frequency bands can accordingly be obtained, and the mount area for the composite antenna 1 can be reduced and handling thereof facilitated.

Here, a description will be provided with regard to the dimensions of the composite antenna 1 according to the first embodiment of the present invention which is shown in FIGS. 1 to 8.

When the first antenna 2 is a GPS antenna and the wavelength for a frequency 1.57542 GHz in the 1.5 GHz band is $\lambda_1$, and the second antenna 3 is an ETC antenna and the wavelength for a center frequency 5.82 GHz in the 5.8 GHz band is $\lambda_2$, the diameter R of the dielectric substrate 10 is equal to or more than approximately 0.52 $\lambda_1$, and the thickness h1 of the dielectric substrate 10 is approximately 0.07 $\lambda_1$. Further, the loop element radius r of the first antenna 2 is approximately 0.19 $\lambda_1$, the length L of the perturbation elements 2*a* is approximately 0.07 $\lambda_1$, and the loop element line width W of the first antenna 2 is approximately 0.03 $\lambda_1$. In addition, the length a of one of the vertical and lateral edges of the second antenna 3 is approximately 0.5 $\lambda_2$, the length b of the degeneracy isolation elements 3*a* is approximately 0.1 $\lambda_2$, the diameter C of the second earth pattern 13 is approximately 0.7 $\lambda_2$ to 1.2 $\lambda_2$, and the gap h2 between the second antenna 3 and the second earth pattern 13 is approximately 0.03 $\lambda_2$ to 0.13 $\lambda_2$.

The antenna characteristics of the composite antenna 1 according to the first embodiment of the present invention when same has the dimensions above are shown in FIGS. 9 to 20.

Figure 9:
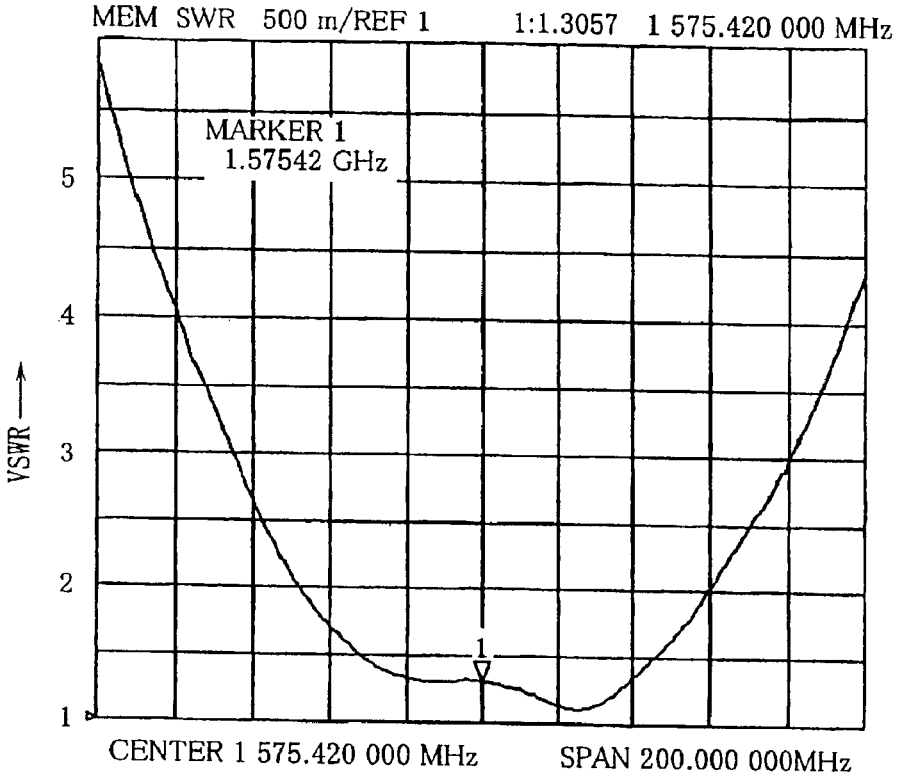
FIG. 9 is a graph showing the VSWR characteristic in the GPS band of the composite antenna according to the first embodiment of the present invention.
Figure 10:
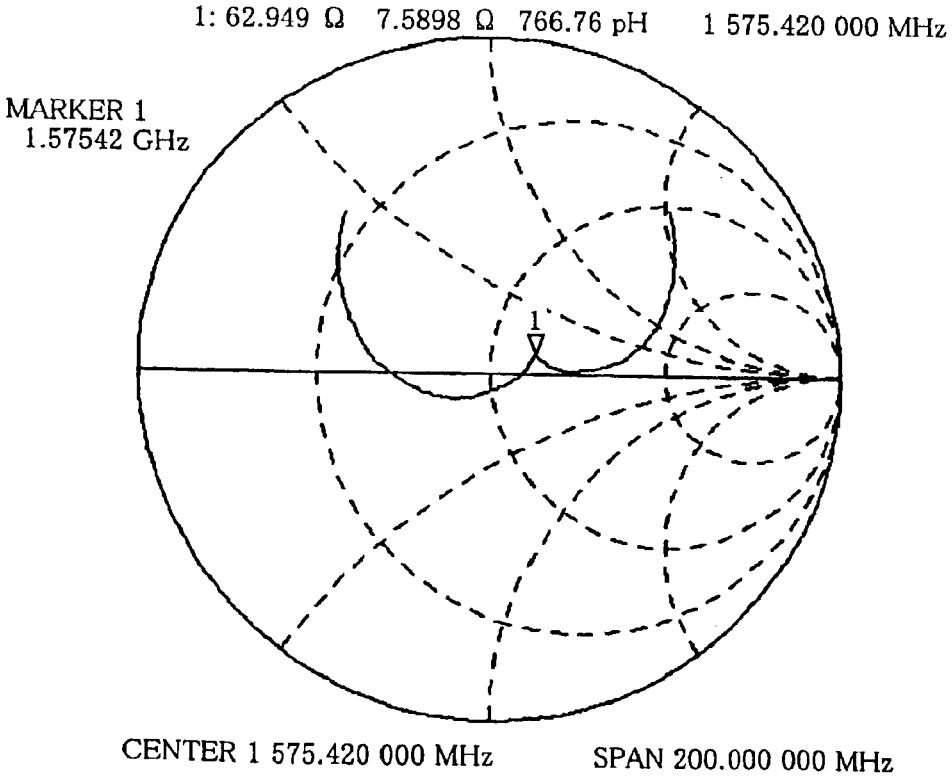
FIG. 10 is a Smith chart showing the impedance characteristic in the GPS band of the composite antenna according to the first embodiment of the present invention.
Figure 11:
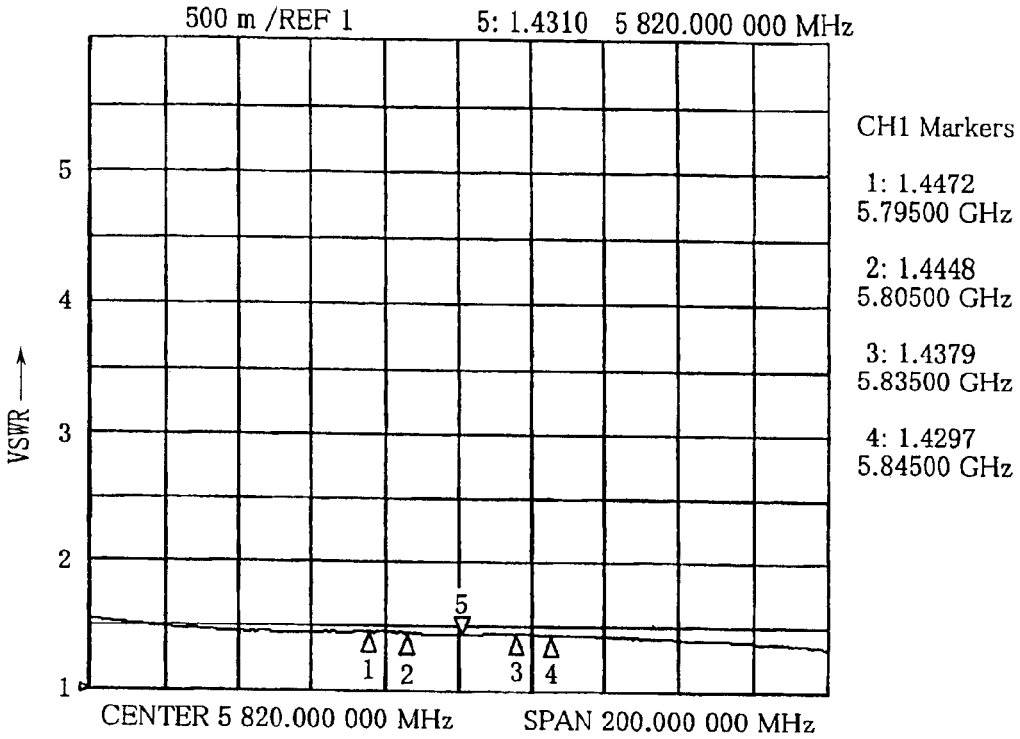
FIG. 11 is a graph showing the VSWR characteristic in the ETC band of the composite antenna according to the first embodiment of the present invention.
Figure 12:
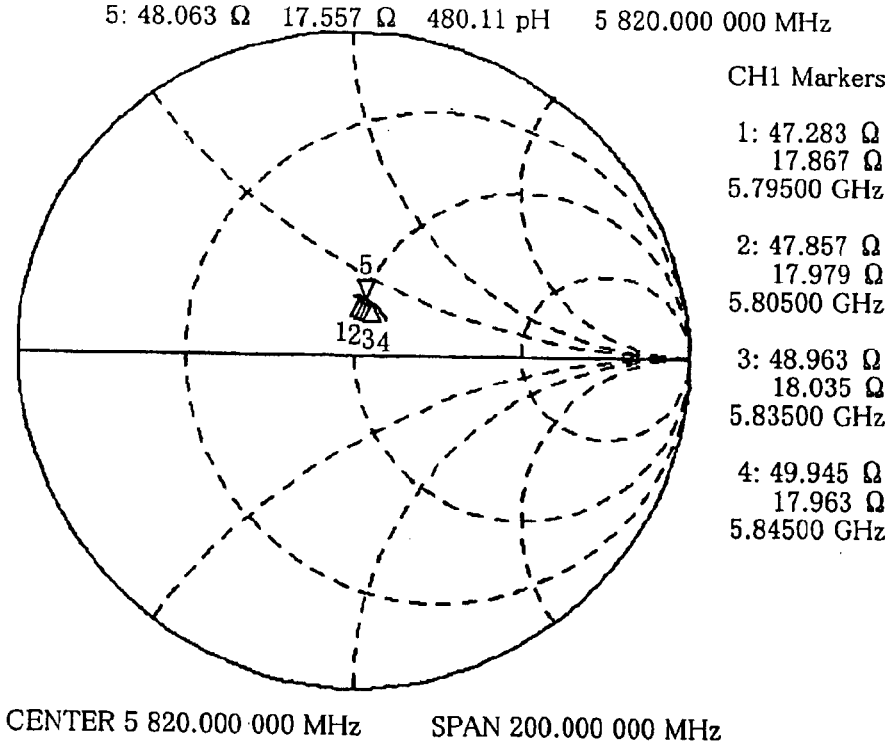
FIG. 12 is a Smith chart showing the impedance characteristic in the ETC band of the composite antenna according to the first embodiment of the present invention.

FIG. 9 shows the VSWR characteristic in the GPS band of the first antenna 2. Referring to FIG. 9, a favorable VSWR of approximately 1.3 is obtained at the 1.57542 GHz employed in the GPS band. Further, FIG. 10 is a Smith chart showing the impedance characteristic in the GPS band of the first antenna 2. Referring now to FIG. 10, favorable normalized impedance which is close to 1 is obtained at the 1.57542 GHz employed in the GPS band. In addition, FIG. 11 shows the VSWR characteristic in the ETC frequency band of the second antenna 3. Referring now to FIG. 11, a favorable VSWR of no more than approximately 1.45 is obtained in the ETC frequency band indicated by the markers 1 through 4. Furthermore, FIG. 12 is a Smith chart showing the impedance characteristic in the ETC frequency band of the second antenna 3. Referring now to FIG. 12, favorable normalized impedance that is close to 1 is obtained in the ETC frequency band indicated by the markers 1 through 4.

Figure 13:
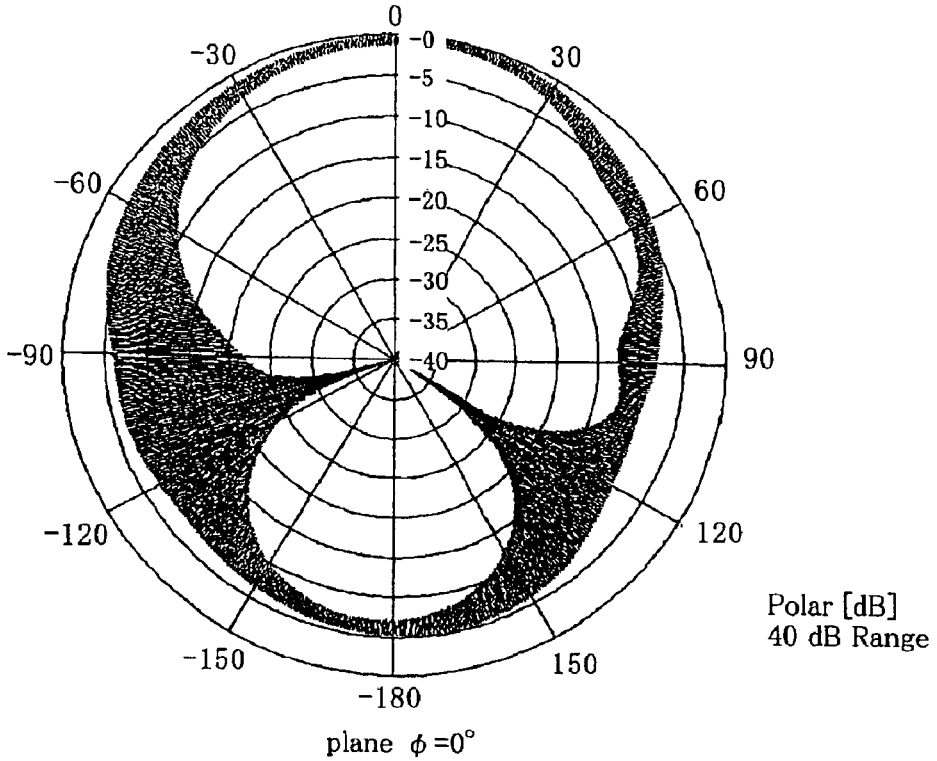
FIG. 13 shows the axial ratio characteristic in the plane ø=0° in the GPS band of the composite antenna according to the first embodiment of the present invention.
Figure 14:
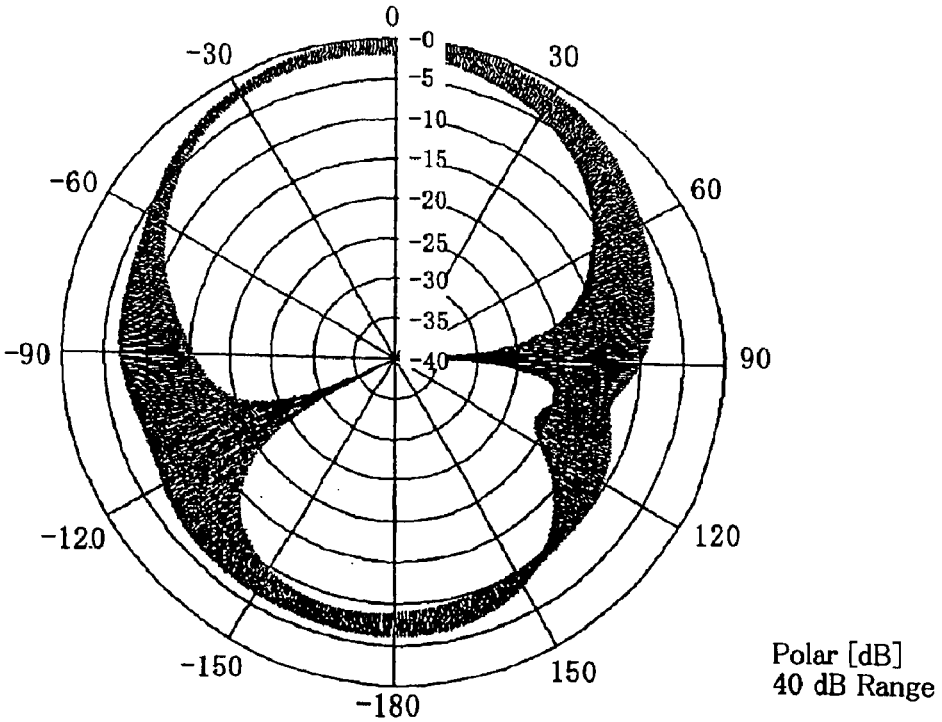
FIG. 14 shows the axial ratio characteristic in the plane ø=90° in the GPS band of the composite antenna according to the first embodiment of the present invention.
Figure 15:
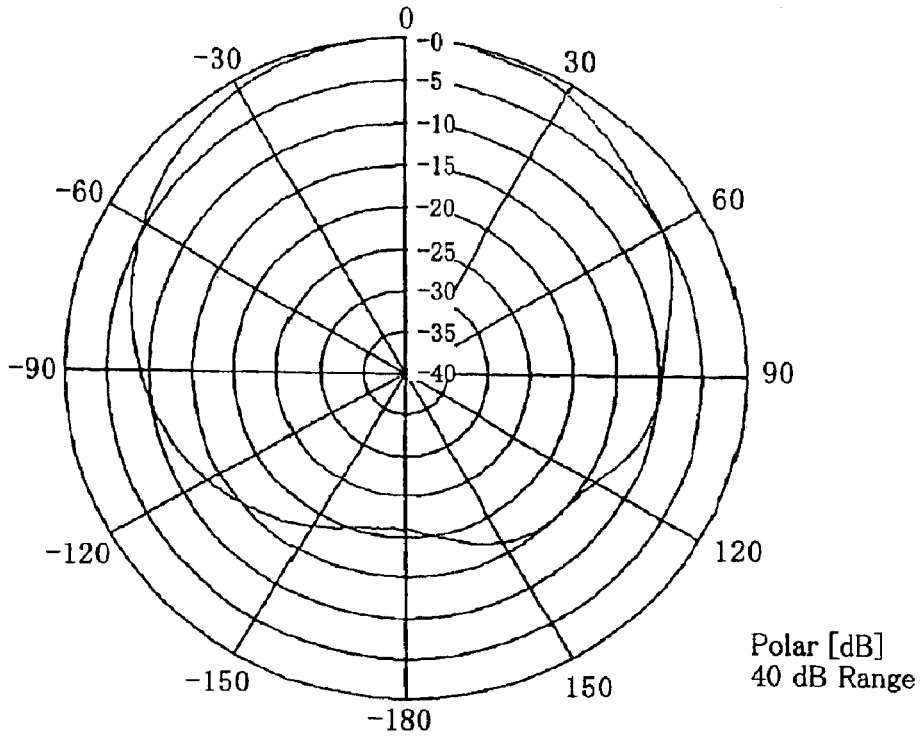
FIG. 15 shows the directional characteristic in the plane ø=0° in the GPS band of the composite antenna according to the first embodiment of the present invention.
Figure 16:
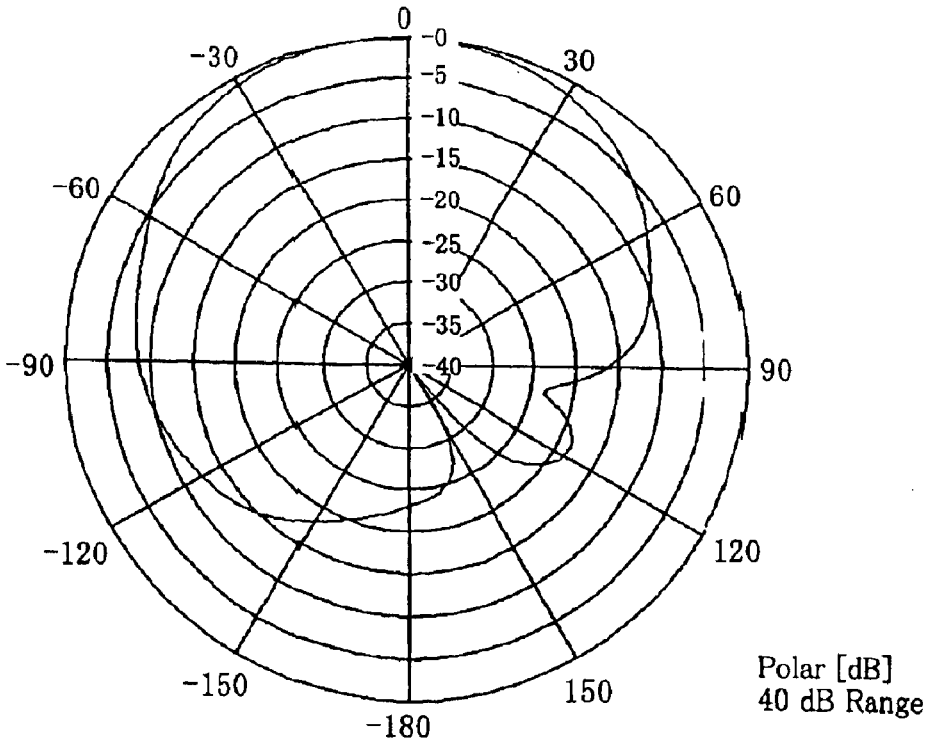
FIG. 16 shows the directional characteristic in the plane ø=90° in the GPS band of the composite antenna according to the first embodiment of the present invention.

FIG. 13 shows the axial ratio characteristic in the plane ø=0° (the direction passing from the center through the middle of the perturbation elements 2*a*) in the GPS band of the first antenna 2. Referring now to FIG. 13, a favorable axial ratio is obtained in the ranges of approximately 0° to 90° and approximately 0° to −60°. Further, FIG. 14 shows the axial ratio characteristic in the plane ø=90° in the GPS band of the first antenna 2. Referring now to FIG. 14, a favorable axial ratio is obtained in the ranges of approximately 0° to 60° and approximately 0° to −80°. In addition, FIG. 15 shows the directional characteristic (GPS band) in the plane ø=0° for right-handed polarized waves of the first antenna 2. Referring now to FIG. 15, a favorable directional characteristic within −10 dB is obtained in the range 90° to −90°. Furthermore, FIG. 16 shows the directional characteristic (GPS band) in the plane ø=90° for right-handed polarized waves of the first antenna 2. Referring now to FIG. 16, a favorable directional characteristic within −10 dB is obtained in the range 75° to −90°.

Figure 17:
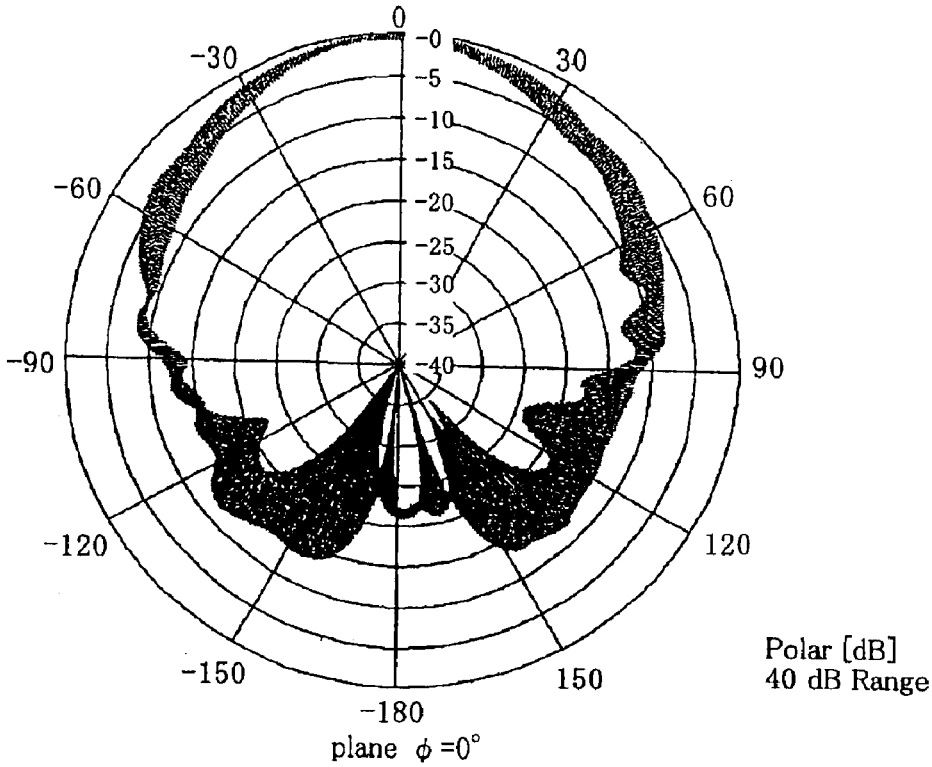
FIG. 17 shows the axial ratio characteristic in the plane ø=0° in the ETC band of the composite antenna according to the first embodiment of the present invention.
Figure 18:
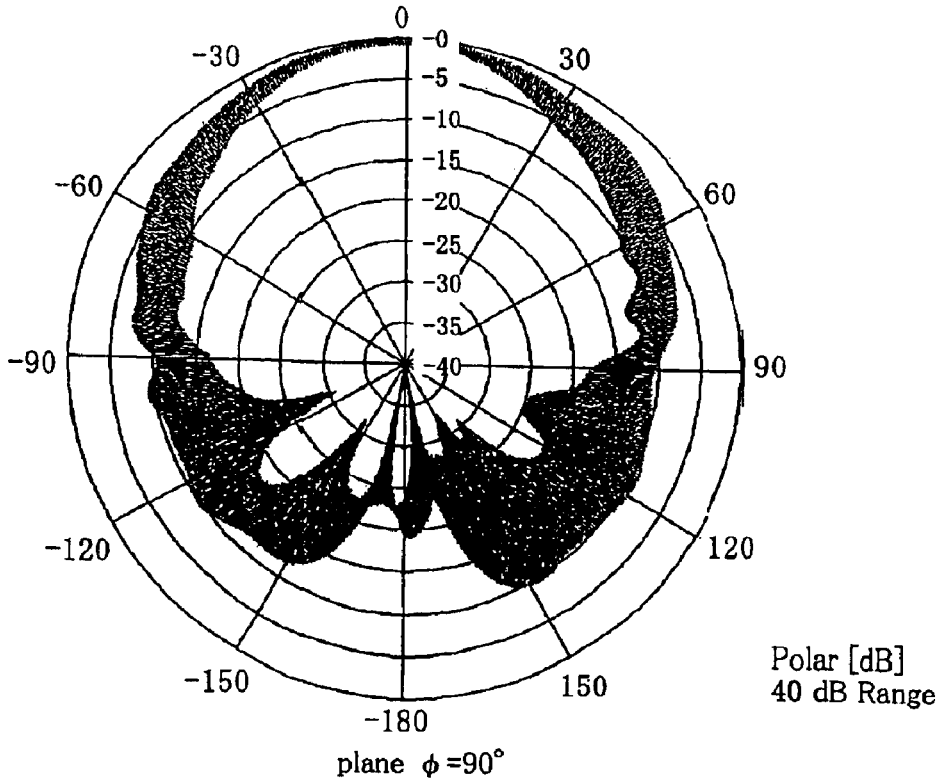
FIG. 18 shows the axial ratio characteristic in the plane ø=90° in the ETC band of the composite antenna according to the first embodiment of the present invention.
Figure 19:
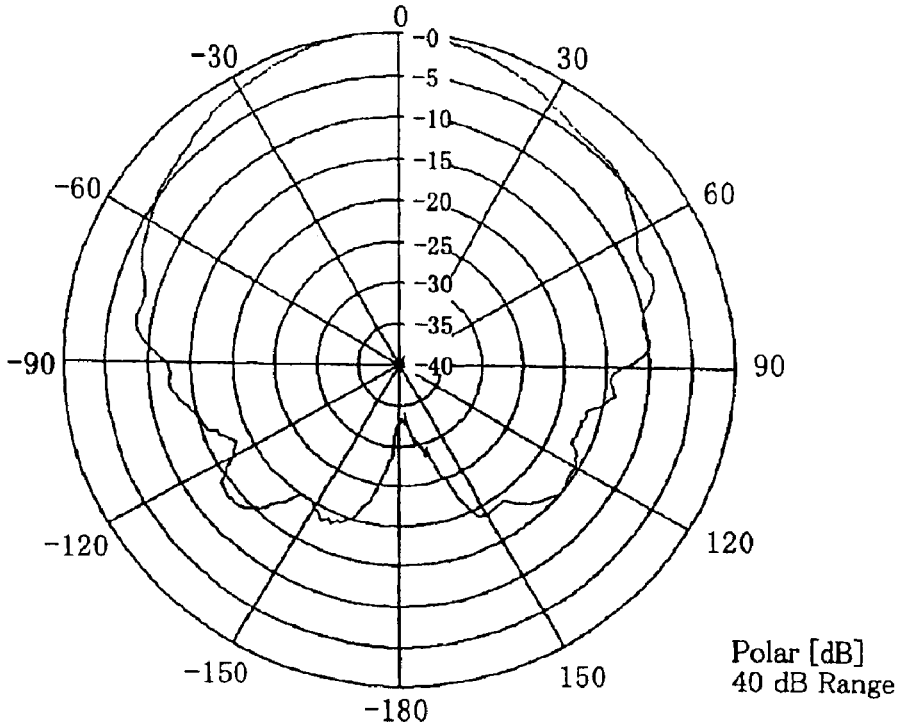
FIG. 19 shows the directional characteristic in the plane ø=0° in the ETC band of the composite antenna according to the first embodiment of the present invention.
Figure 20:
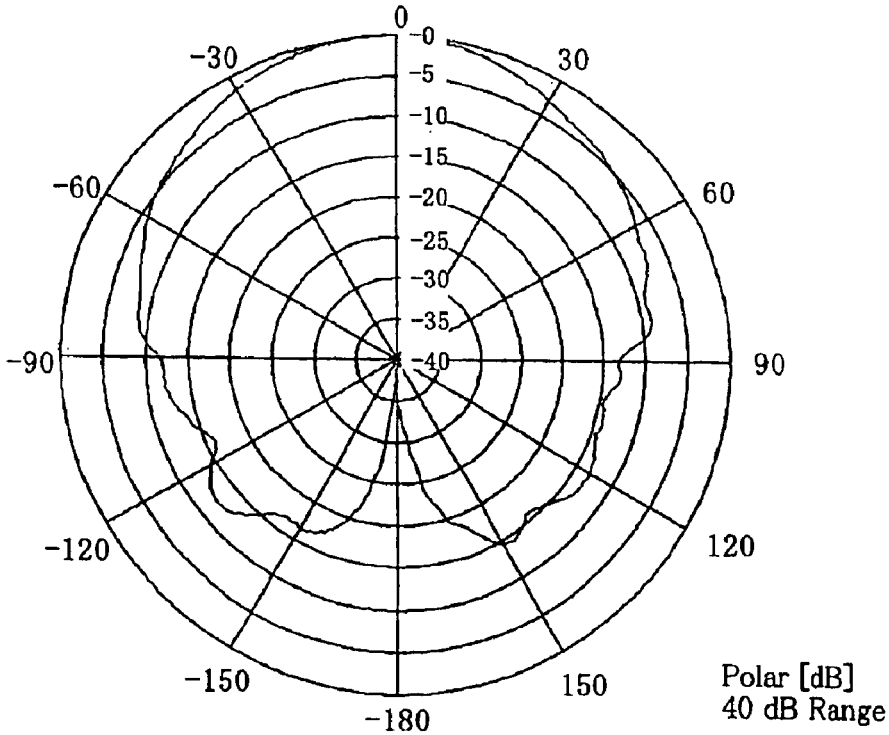
FIG. 20 shows the directional characteristic in the plane ø=90° in the ETC band of the composite antenna according to the first embodiment of the present invention.

FIG. 17 shows the axial ratio characteristic in the plane ø=0° in the ETC frequency band of the second antenna 3. Referring now to FIG. 17, a favorable axial ratio is obtained in the range 90° to −90°. Further, FIG. 18 shows the axial ratio characteristic in the plane ø=90° in the ETC frequency band of the second antenna 3. Referring now to FIG. 18, a favorable axial ratio is obtained in the range 90° to −90°. Also, FIG. 19 shows the directional characteristic (ETC band) in the plane ø=0° for right-handed polarized waves of the second antenna 3. Referring now to FIG. 19, a favorable directional characteristic within −10 dB is obtained in the range 80° to −85°. Furthermore, FIG. 20 shows the directional characteristic (ETC band) in the plane ø=90° for right-handed polarized waves of the second antenna 3. Referring now to FIG. 20, a favorable directional characteristic within −10 dB in the range 85° to −90° is obtained.

Figure 21:
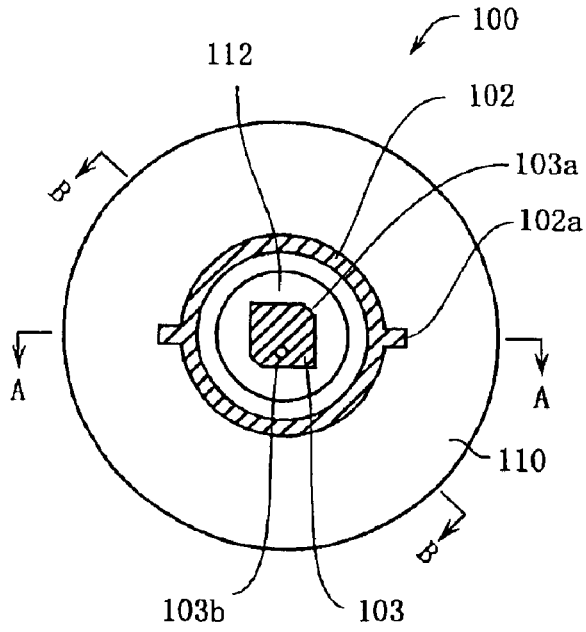
FIG. 21 is a planar view of the constitution of the composite antenna according to a second embodiment of the present invention.
Figure 22:
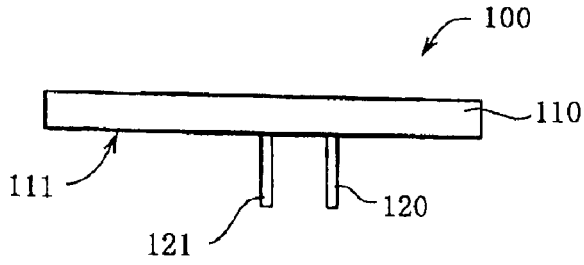
FIG. 22 is a side view of the constitution of the composite antenna according to the second embodiment of the present invention.
Figure 23:
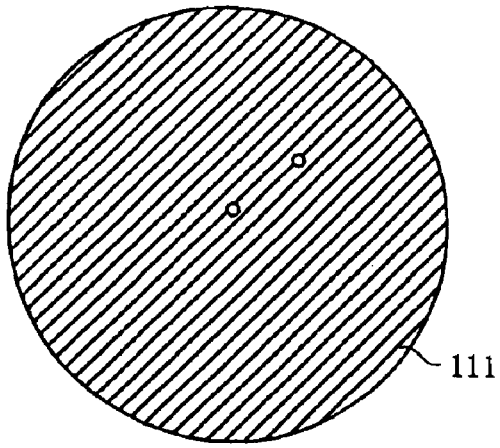
FIG. 23 is a rear view of the constitution of the composite antenna according to the second embodiment of the present invention.
Figure 24:
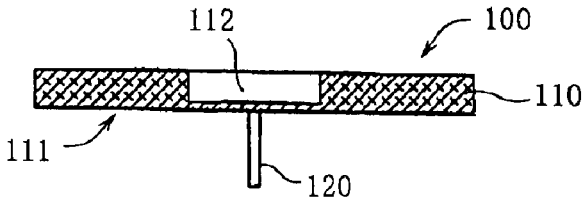
FIG. 24 is a cross-sectional view along the line A—A of the constitution of the composite antenna according to the second embodiment of the present invention.
Figure 25:
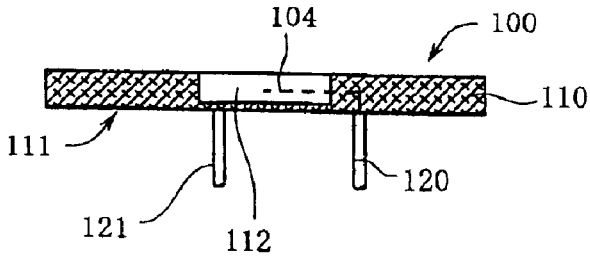
FIG. 25 is a cross-sectional view along the line B—B of the constitution of the composite antenna according to the second embodiment of the present invention.
Figure 26:
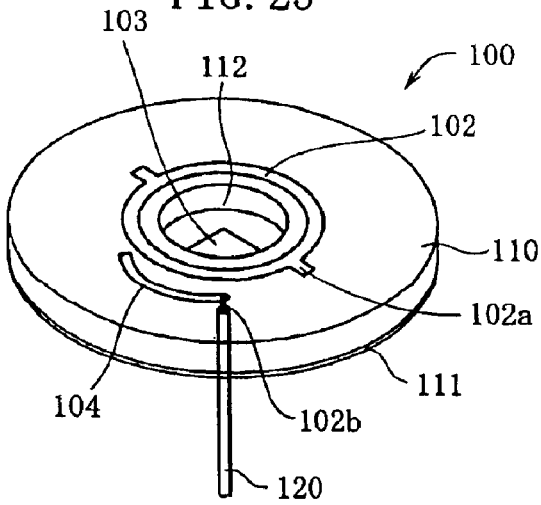
FIG. 26 is a perspective view of an outline constitution of the composite antenna according to the second embodiment of the present invention.
Figure 27:
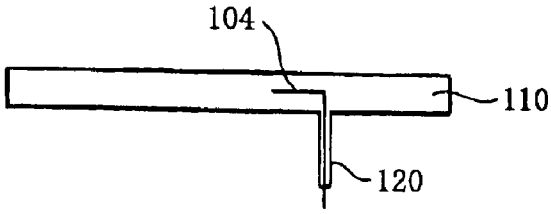
FIG. 27 is a side view of an outline constitution of the composite antenna according to the second embodiment of the present invention.

Next, the constitution of the composite antenna according to the second embodiment of the present invention is shown in FIGS. 21 to 28, where FIG. 21 is a planar view of a second composite antenna 100 according to the present invention; FIG. 22 is a side view thereof; FIG. 23 is a rear view thereof; FIG. 24 is a cross-sectional view thereof along the line A—A; FIG. 25 is a cross-sectional view thereof along the line B—B; FIG. 26 is a perspective view showing the outline constitution thereof; and FIG. 27 is a side view showing the outline constitution thereof.

The second composite antenna 100 shown in FIGS. 21 to 27 is a two-frequency composite antenna and is constituted to operate as a 5.8 GHz-band DSRC antenna for ETC or similar and as a 1.5 GHz-band GPS antenna, for example. A first antenna 102 is formed by a print pattern in the upper surface of a circular dielectric substrate 110 which constitutes the composite antenna 100. The first antenna 102 is a loop antenna, and is constituted as a circularly polarized antenna as a result of being formed having a pair of perturbation elements 102*a* that lie opposite each other in an outward direction.

Further, a recess 112 of a predetermined depth is formed substantially in the center of the upper surface of the dielectric substrate 110; a second antenna 103 is formed by a print pattern so as to lie substantially in the center of the bottom face of the recess 112. The second antenna 103 is a square patch antenna and is constituted as a circularly polarized antenna as a result of being formed with a top having a pair of opposing degeneracy isolation elements 103*a*. In addition, an earth pattern 111 is formed over the whole of the underside of the dielectric substrate 110. In the case of this composite antenna 100, the first antenna 102 is constituted to operate as a right-handed circularly polarized antenna as a result of electricity being supplied from an arc-shaped feed pattern 104 which is disposed so as to be electromagnetically coupled to this first antenna. This feed pattern 104 is disposed so as to be embedded within the dielectric substrate 110, this dielectric substrate 110 being shown as a transparent substrate in FIGS. 26 and 27. The core of a first feed line 120 which is a coaxial cable is connected to a first feed point 102*b* of the feed pattern 104, and the shield of the first feed line 120 is connected to the earth pattern 111. Further, because electricity is supplied by connecting the core of a second feed line 121 which is a coaxial cable to the second feed point 103*b* of the second antenna 103, the second antenna 103 is made to operate as a right-handed circularly polarized antenna. Further, the shield of the second feed line 121 is also connected to the earth pattern 111.

The recess 112 is provided in the upper face of the dielectric substrate 110 in order to reduce the gap between the second antenna 103 and the earth pattern 111. The gap is reduced in this way in order that the gap from the earth pattern of the patch antenna should be small in comparison with the loop antenna. The dielectric substrate 110 can be a Teflon substrate or another resin substrate and may be a substrate comprising a layer consisting substantially of air such as a honeycomb core substrate.

Figure 28:
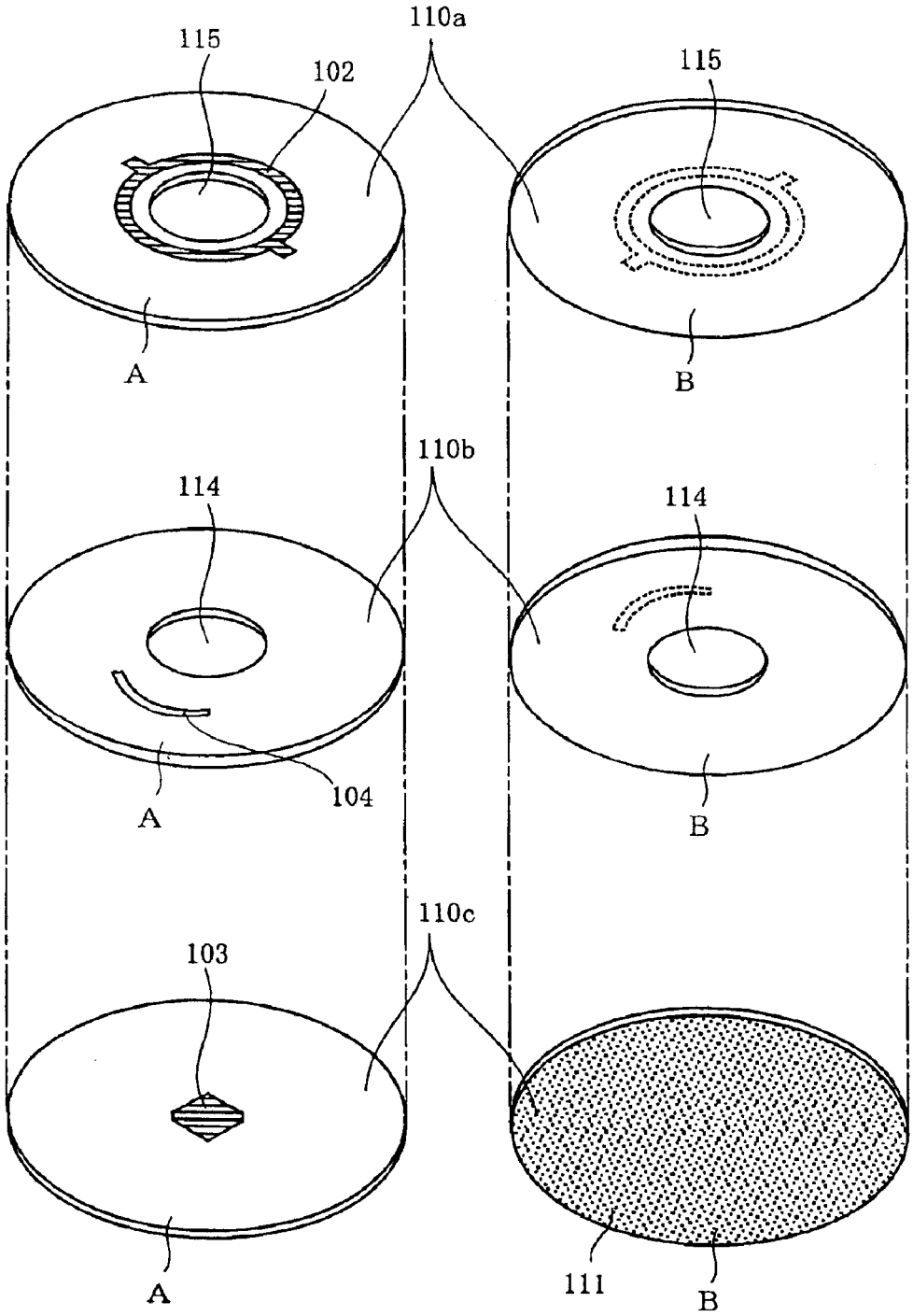
FIG. 28 is a development drawing that serves to illustrate the method for creating the composite antenna according to the second embodiment of the present invention.

An example of a method for creating the composite antenna 100 according to the second embodiment of the present invention is illustrated in FIG. 28.

According to this creation method, the composite antenna 100 is created by combining three dielectric substrates constituted by print substrates which are circular and of substantially equal diameter. A through-hole 115 for the formation of the recess 112 is formed substantially in the center of a first dielectric substrate 110*a* which lies uppermost, and a pattern for the first antenna 102 is formed so as to surround the through-hole 115, in the upper surface A of this substrate; a through-hole 114 for the formation of the recess 112 is formed substantially in the center of a second intermediate dielectric substrate 110*b*, the arc-shaped feed pattern 104 which is electromagnetically coupled to the first antenna 102 being formed in the upper surface A of this substrate.

In addition, a pattern for the second antenna 103 is formed substantially in the center of the upper surface of a third dielectric substrate 110*c* that lies lowermost, and the earth pattern 111 is formed over the whole of the underside B of this substrate. The second composite antenna 100 according to the present invention can be created by aligning and combining these three dielectric substrates 110*a*, 110*b* and

110*c*. The patterns of the dielectric substrates 110*a*, 110*b* and 110*c* are formed by plating the substrates with copper foil, or an electrically conductive material, or the like.

The second composite antenna 100 according to the present invention comprises a first antenna 102 which is a circularly polarized loop antenna that operates in the GPS band and which is formed on the dielectric substrate 110. Because this antenna is a loop antenna, the space therein can be utilized. Therefore, in the case of the second composite antenna 100 according to the present invention, a second antenna 103 that is a square patch antenna which operates in the ETC frequency band is disposed in the space in the first antenna 102 so as to lie on substantially the same axis as the first antenna 102. A small composite antenna which is capable of operating in two different frequency bands can accordingly be obtained, and the mount area for the composite antenna 100 can be reduced and handling thereof facilitated.

Here, a description will be provided with regard to the dimensions of the composite antenna 100 according to the second embodiment of the present invention which is shown in FIGS. 21 to 28.

When the first antenna 102 is a GPS antenna, and the second antenna 103 is an ETC antenna, the diameter of the dielectric substrate 110 is equal to or more than approximately 0.52 $\lambda_1$, and the thickness of the dielectric substrate 110 is approximately 0.07 $\lambda_1$. Further, the loop element radius of the first antenna 102 is approximately 0.19 $\lambda_1$, the length L of the perturbation elements 102*a* is approximately 0.07 $\lambda_1$, and the loop element line width W of the first antenna 102 is approximately 0.03 $\lambda_1$. In addition, the length of one of the vertical and lateral edges of the second antenna 103 is approximately 0.5 $\lambda_2$, the length b of the degeneracy isolation elements 103*a* is approximately 0.1 $\lambda_2$, and the gap between the second antenna 103 and the earth pattern 111 is approximately 0.03 $\lambda_2$ to 0.13 $\lambda_2$.

Figure 29:
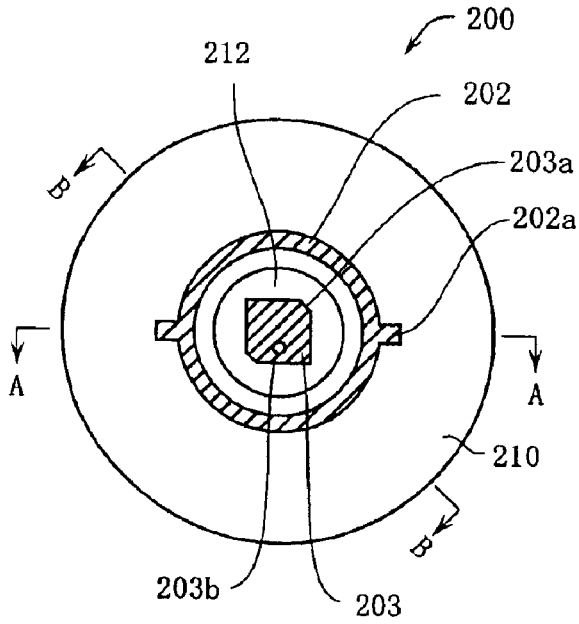
FIG. 29 is a planar view of the constitution of the composite antenna according to a third embodiment of the present invention.
Figure 30:
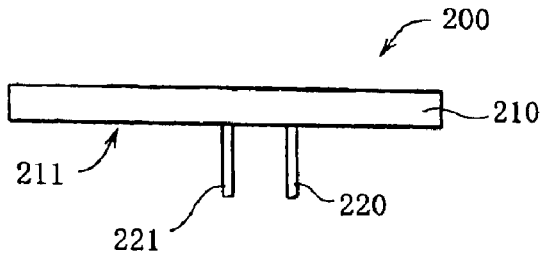
FIG. 30 is a side view of the constitution of the composite antenna according to the third embodiment of the present invention.
Figure 31:
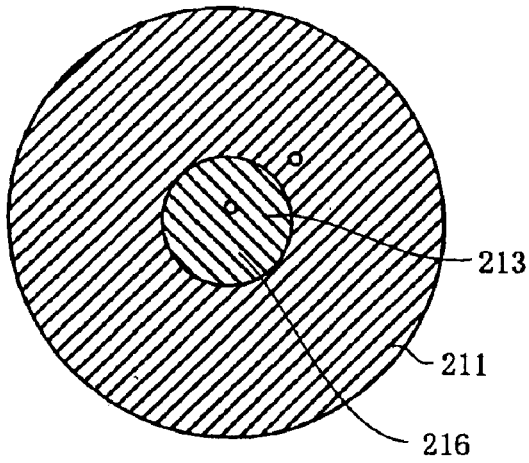
FIG. 31 is a rear view of the constitution of the composite antenna according to the third embodiment of the present invention.
Figure 32:
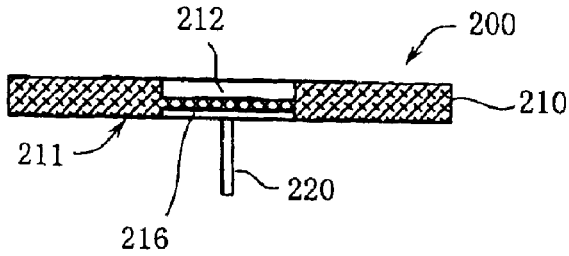
FIG. 32 is a cross-sectional view along the line A—A of the constitution of the composite antenna according to the third embodiment of the present invention.
Figure 33:
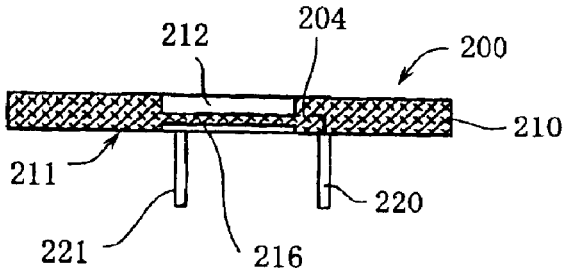
FIG. 33 is a cross-sectional view along the line B—B of the constitution of the composite antenna according to the third embodiment of the present invention.
Figure 34:
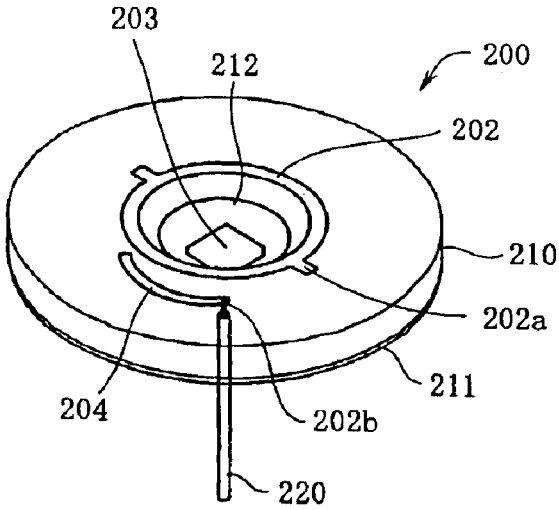
FIG. 34 is a perspective view of an outline constitution of the composite antenna according to the third embodiment of the present invention.
Figure 35:
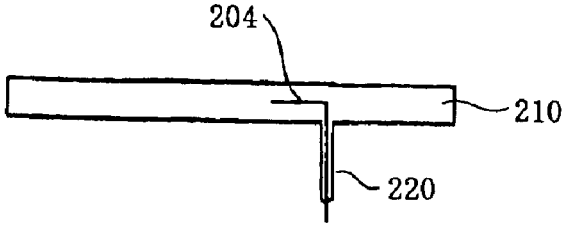
FIG. 35 is a side view of an outline constitution of the composite antenna according to the third embodiment of the present invention.

Next, the constitution of the composite antenna according to the third embodiment of the present invention is shown in FIGS. 29 through 35, where FIG. 29 is a planar view of a third composite antenna 200 according to the present invention; FIG. 30 is a side view thereof; FIG. 31 is a rear view thereof; FIG. 32 is a cross-sectional view thereof along the line A—A; FIG. 33 is a cross-sectional view thereof along the line B—B; FIG. 34 is a perspective view showing an outline constitution thereof; and FIG. 35 is a side view showing an outline constitution thereof.

The third composite antenna 200 shown in FIGS. 29 to 35 is a two-frequency composite antenna and is constituted to operate as a 5.8 GHz-band DSRC antenna for ETC or similar and as a 1.5 GHz-band GPS antenna, for example. A first antenna 202 is formed by a print pattern in the upper surface of a circular dielectric substrate 210 which constitutes the composite antenna 200. The first antenna 202 is a loop antenna, and is constituted as a circularly polarized antenna as a result of being formed having a pair of perturbation elements 202*a* that lie opposite each other in an outward direction.

Further, an upper recess 212 of a predetermined depth is formed substantially in the center of the upper surface of the dielectric substrate 210; a second antenna 203 is formed by a print pattern so as to lie substantially in the center of the bottom face of the upper recess 212. The second antenna 203 is a square patch antenna and is constituted as a circularly polarized antenna as a result of being formed with a top having a pair of opposing degeneracy isolation elements 203*a*. In addition, a first earth pattern 211 is formed over the whole of the underside of the dielectric substrate 210. Further, a lower recess 216 of a predetermined depth is formed substantially in the center of the underside of the dielectric substrate 210, and a circular second earth pattern 213 is formed in the bottom face of the lower recess 216. In the case of this composite antenna 200, the first antenna 202 is constituted to operate as a right-handed circularly polarized antenna as a result of electricity being supplied from an arc-shaped feed pattern 204 which is disposed so as to be electromagnetically coupled to this first antenna. This feed pattern 204 is disposed so as to be embedded within the dielectric substrate 210, this dielectric substrate 210 being shown as a transparent substrate in FIGS. 34 and 35. The core of a first feed line 220 which is a coaxial cable is connected to a first feed point 202*b* of the feed pattern 204, and the shield of the first feed line 220 is connected to the first earth pattern 211. Further, because electricity is supplied by connecting the core of a second feed line 221 which is a coaxial cable to the second feed point 203*b* of the second antenna 203, the second antenna 203 is made to operate as a right-handed circularly polarized antenna. Further, the shield of the second feed line 221 is connected to the second earth pattern 213.

The upper recess 212 is provided in the upper face of the dielectric substrate 210 and the lower recess 216 is provided in the underside of this substrate in order to reduce the gap between the second antenna 203 and the second earth pattern 213. The gap is reduced in this way in order that the gap from the earth pattern of the patch antenna should be small in comparison with the loop antenna. The dielectric substrate 210 can be a Teflon substrate or another resin substrate and may be a substrate comprising a layer consisting substantially of air such as a honeycomb core substrate.

Figure 36:
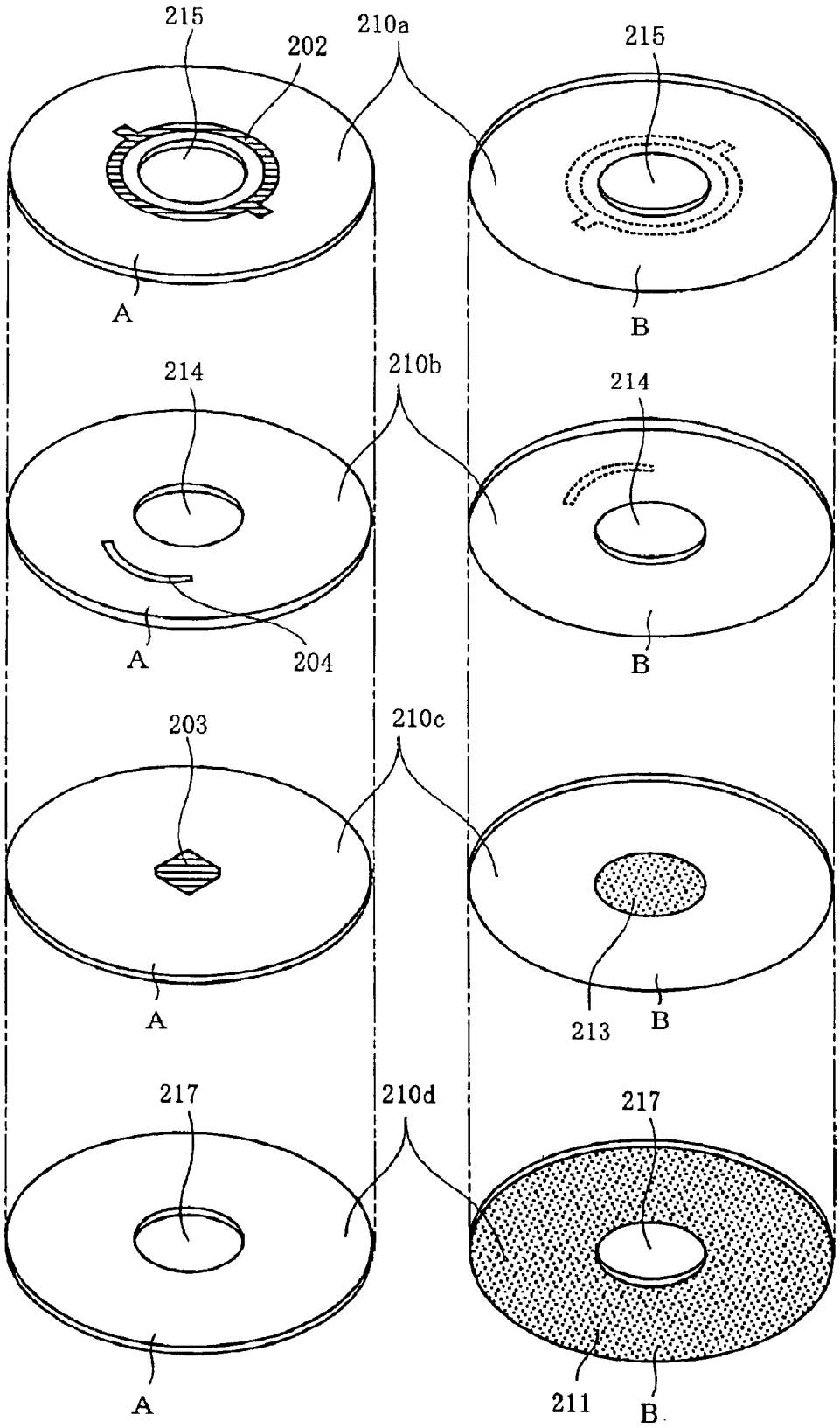
FIG. 36 is a development drawing that serves to illustrate the method for creating the composite antenna according to the third embodiment of the present invention.

An example of a method for creating the composite antenna 200 according to the third embodiment of the present invention is illustrated in FIG. 36.

According to this creation method, the composite antenna 200 is created by combining four dielectric substrates constituted by print substrates which are circular and of substantially equal diameter. A through-hole 215 for the formation of the upper recess 212 is formed substantially in the center of a first dielectric substrate 210*a* which lies uppermost, and a pattern for the first antenna 202 is formed so as to surround the through-hole 215, in the upper surface A of this substrate; a through-hole 214 for the formation of the upper recess 212 is formed substantially in the center of a second intermediate dielectric substrate 210*b*, the feed pattern 204 which is electromagnetically coupled to the first antenna 202 being formed in the upper surface A of this substrate.

A pattern for the second antenna 203 is formed substantially in the center of the upper surface of a third dielectric substrate 210*c* that is disposed below the second dielectric substrate 210*b*, and the circular second earth pattern 213 is formed substantially in the center of the underside B of this substrate. In addition, a through-hole 217 for the formation of the lower recess 216 is formed substantially in the center of a fourth dielectric substrate 210*d* that lies lowermost, and the first earth pattern 211 is formed over the whole of the underside B of this substrate. Further, an electrically conductive film may be formed on the circumferential side face of the through-hole 217. The third composite antenna 200 according to the present invention can be created by aligning and combining these four dielectric substrates 210*a*, 210*b*, 210*c*, and 210*d*. The patterns of the dielectric substrates 210*a*, 210*b*, 210*c*, and 210*d* are formed by plating the substrates with copper foil, or an electrically conductive material, or the like.

The third composite antenna 200 according to the present invention comprises a first antenna 202 which is a circularly polarized loop antenna that operates in the GPS band and which is formed on the dielectric substrate 210. Because this antenna is a loop antenna, the space therein can be utilized. Therefore, in the case of the third composite antenna 200 according to the present invention, a second antenna 203 that is a square patch antenna which operates in the ETC frequency band is disposed in the space in the first antenna 202 so as to lie on substantially the same axis as the first antenna 202. A small composite antenna which is capable of operating in two different frequency bands can accordingly be obtained, and the mount area for the composite antenna 200 can be reduced and handling thereof facilitated.

Here, a description will be provided with regard to the dimensions of the composite antenna 200 according to the third embodiment of the present invention which is shown in FIGS. 29 to 36.

When the first antenna 202 is a GPS antenna, and the second antenna 203 is an ETC antenna, the diameter of the dielectric substrate 210 is equal to or more than approximately 0.52 $\lambda_1$, and the thickness of the dielectric substrate 210 is approximately 0.07 $\lambda_1$. Further, the loop element radius of the first antenna 202 is approximately 0.19 $\lambda_1$, the length L of the perturbation elements 202*a* is approximately 0.07 $\lambda_1$, and the loop element line width W of the first antenna 202 is approximately 0.03 $\lambda_1$. In addition, the length of one of the vertical and lateral edges of the second antenna 203 is approximately 0.5 $\lambda_2$, the length b of the degeneracy isolation elements 203*a* is approximately 0.1 $\lambda_2$, the diameter of the second earth pattern 213 is approximately 0.7 $\lambda_2$ to 1.2 $\lambda_2$, and the gap between the second antenna 203 and the second earth pattern 213 is approximately 0.03 $\lambda_2$ to 0.13 $\lambda_2$.

The antenna characteristics of the composite antenna 100 according to the second embodiment of the present invention when afforded the dimensions described above and the antenna characteristics of the composite antenna 200 according to the third embodiment are substantially the same antenna characteristics. Therefore, the antenna characteristics of the composite antenna 100 according to the second embodiment of the present invention when afforded the dimensions described above are shown in FIGS. 37 to 48.

Figure 37:
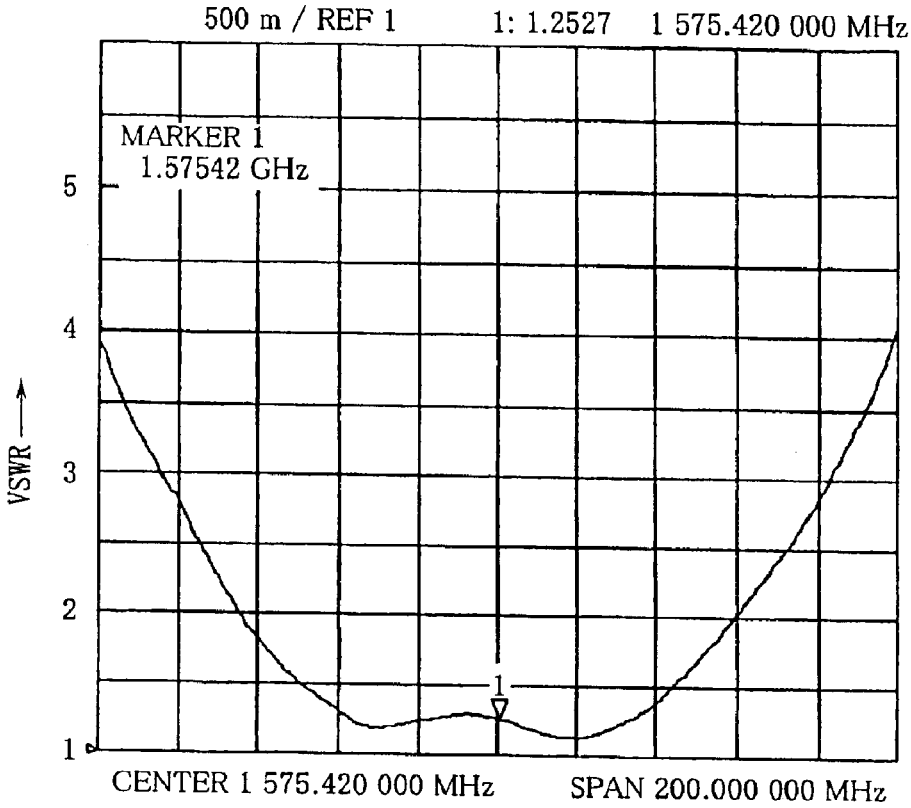
FIG. 37 is a graph showing the VSWR characteristic in the GPS band of the composite antenna according to the second embodiment of the present invention.
Figure 38:
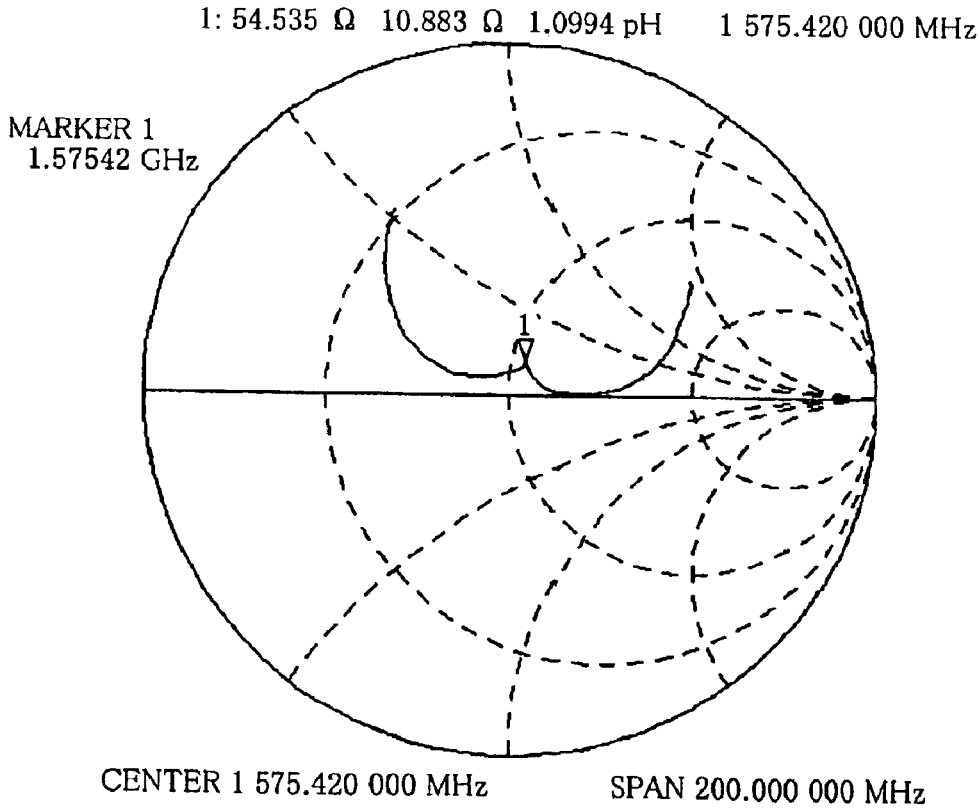
FIG. 38 is a Smith chart showing the impedance characteristic in the GPS band of the composite antenna according to the second embodiment of the present invention.
Figure 39:
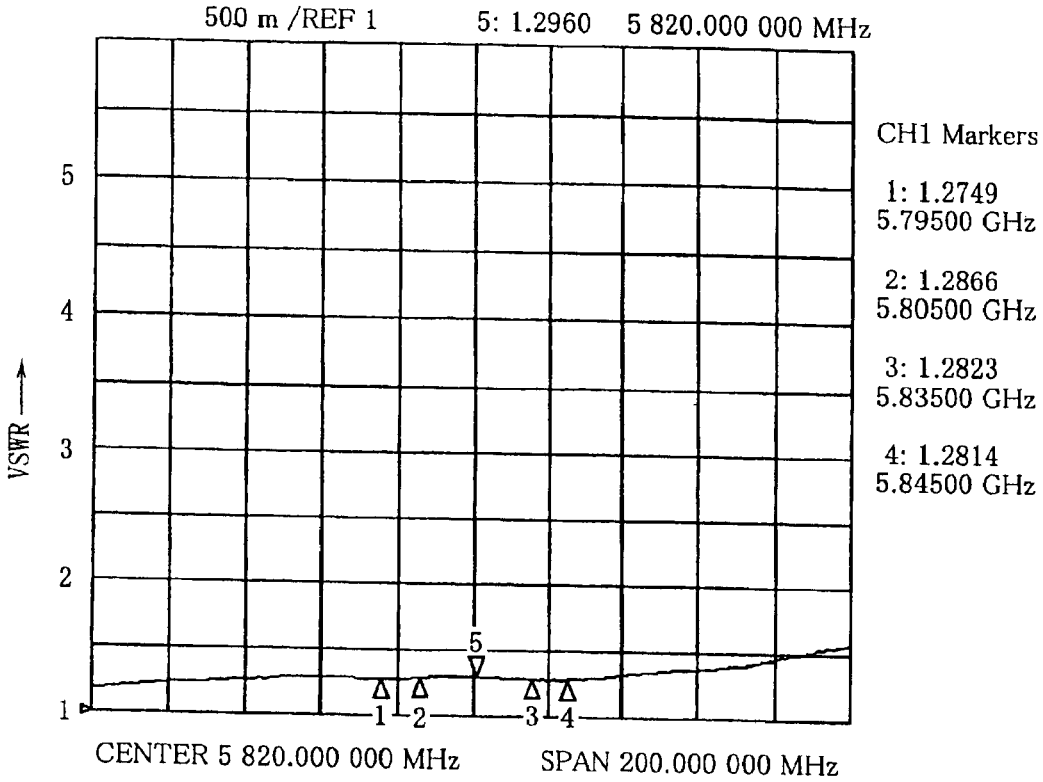
FIG. 39 is a graph showing the VSWR characteristic in the ETC band of the composite antenna according to the second embodiment of the present invention.
Figure 40:
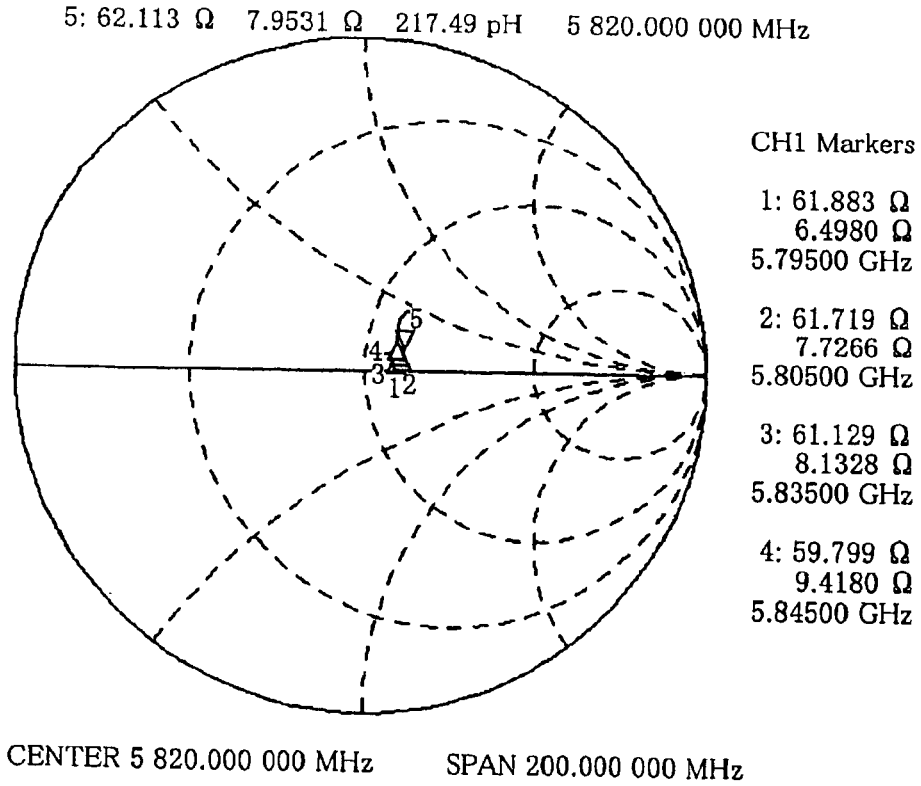
FIG. 40 is a Smith chart showing the impedance characteristic in the ETC band of the composite antenna according to the second embodiment of the present invention.

FIG. 37 shows the VSWR characteristics in the GPS band of the first antenna 102. Referring now to FIG. 37, a favorable VSWR of approximately 1.25 is obtained at the 1.57542 GHz employed in the GPS band. Further, FIG. 38 is a Smith chart showing the impedance characteristic in the GPS band of the first antenna 102. Referring now to FIG. 38, favorable normalized impedance which is close to 1 is obtained at the 1.57542 GHz employed in the GPS band. In addition, FIG. 39 shows the VSWR characteristic in the ETC frequency band of the second antenna 103. Referring now to FIG. 39, a favorable VSWR of no more than approximately 1.29 is obtained in the ETC frequency band indicated by the markers 1 through 4. Furthermore, FIG. 40 is a Smith chart showing the impedance characteristic in the ETC frequency band of the second antenna 103. Referring now to FIG. 40, favorable normalized impedance that is substantially 1 is obtained in the ETC frequency band indicated by the markers 1 through 4.

Figure 41:
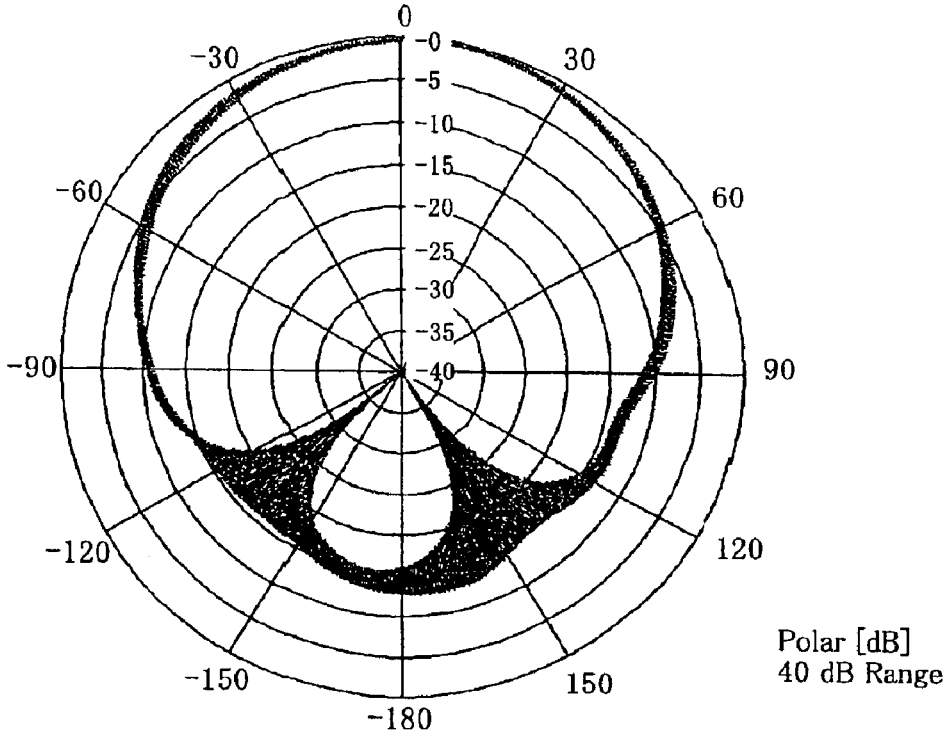
FIG. 41 shows the axial ratio characteristic in the plane ø=0° in the GPS band of the composite antenna according to the second embodiment of the present invention.
Figure 42:
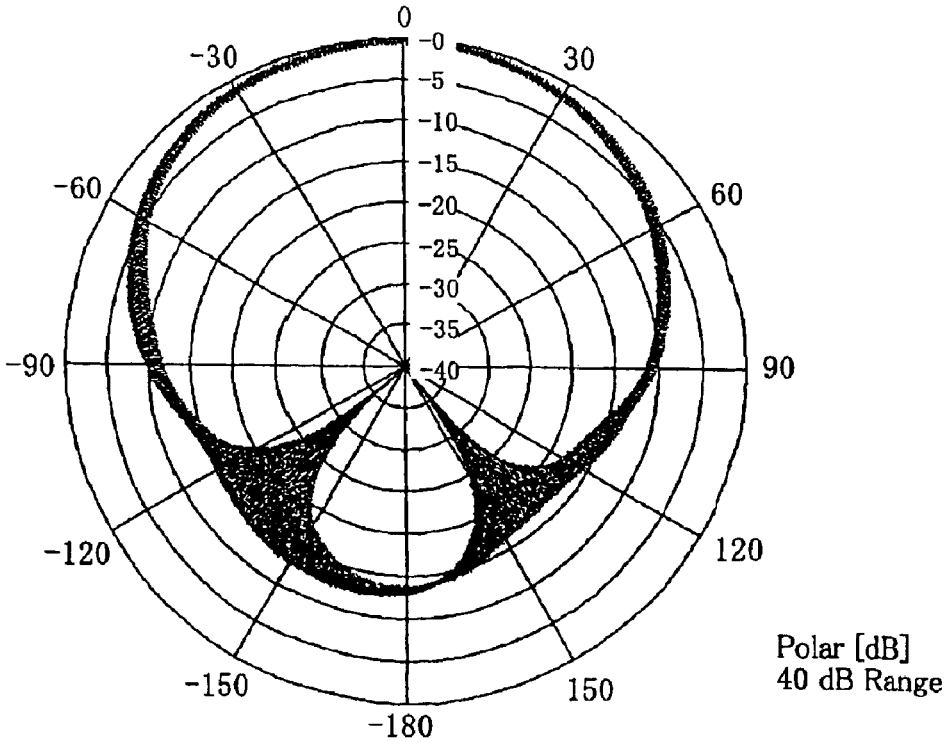
FIG. 42 shows the axial ratio characteristic in the plane ø=90° in the GPS band of the composite antenna according to the second embodiment of the present invention.
Figure 43:
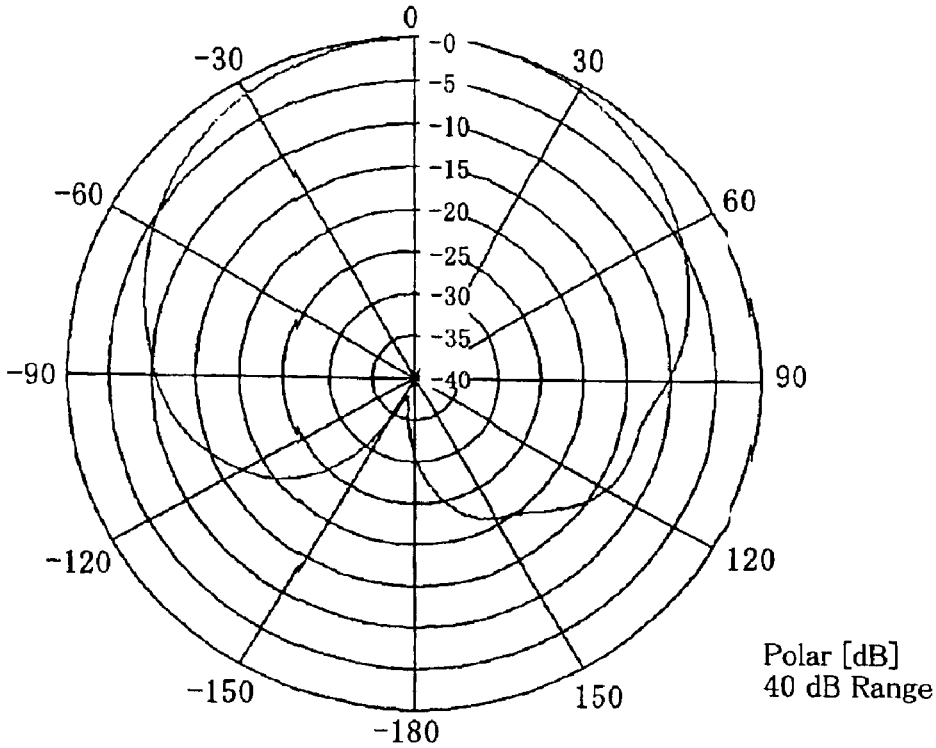
FIG. 43 shows the directional characteristic in the plane ø=0° in the GPS band of the composite antenna according to the second embodiment of the present invention.
Figure 44:
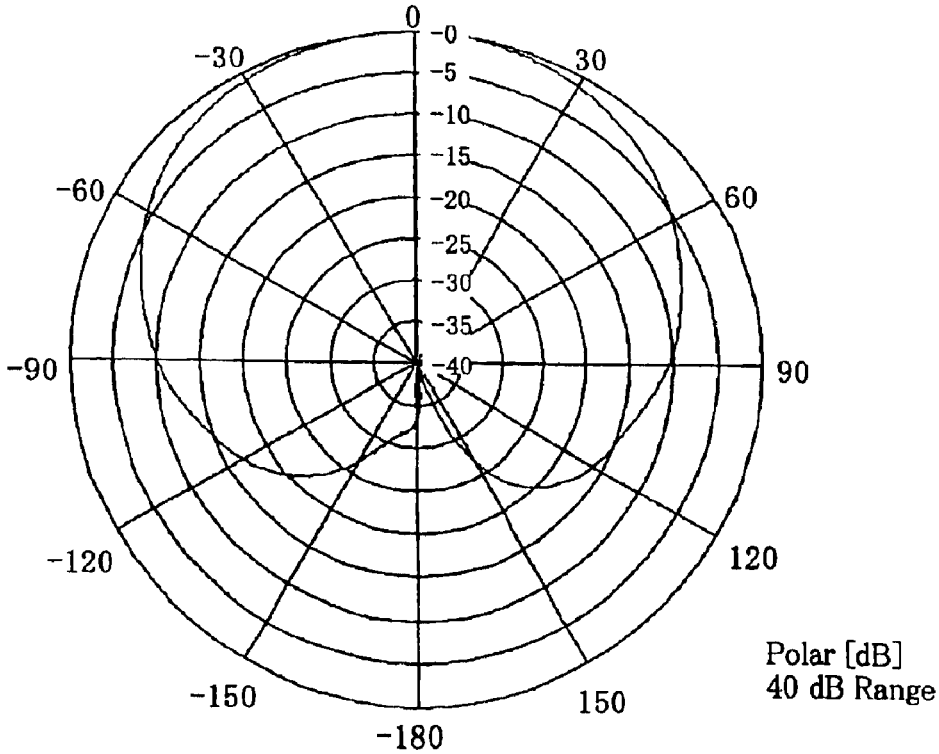
FIG. 44 shows the directional characteristic in the plane ø=90° in the GPS band of the composite antenna according to the second embodiment of the present invention.

FIG. 41 shows the axial ratio characteristic in the plane ø=0° (the direction passing from the center through the middle of the perturbation elements 2*a*) in the GPS band of the first antenna 102. Referring now to FIG. 41, a favorable axial ratio is obtained in the range 90° to −90°. Further, FIG. 42 shows the axial ratio characteristic in the plane ø=90° in the GPS band of the first antenna 102. Referring now to FIG. 42, a favorable axial ratio is obtained in the range 90° to −90°. In addition, FIG. 43 shows the directional characteristic (GPS band) in the plane ø=0° for right-handed polarized waves of the first antenna 102. Referring now to FIG. 43, a favorable directional characteristic within −10 dB is obtained in the range 90° to −90°. Furthermore, FIG. 44 shows the directional characteristic (GPS band) in the plane ø=90° for right-handed polarized waves of the first antenna 102. Referring now to FIG. 44, a favorable directional characteristic within substantially −10 dB is obtained in the range 90° to −90°.

Figure 45:
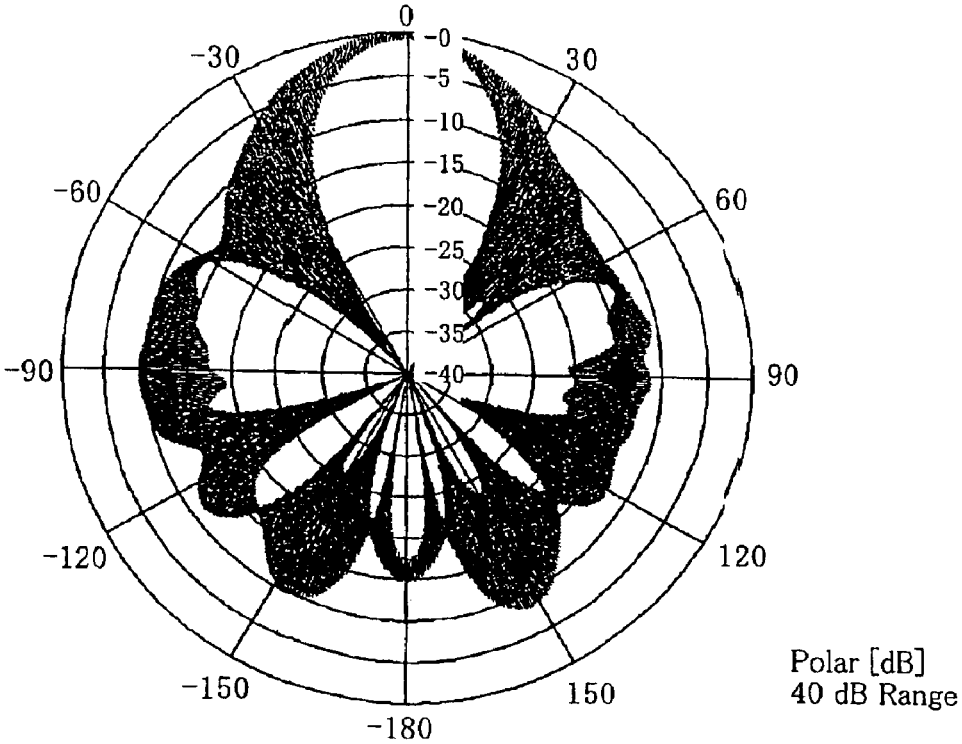
FIG. 45 shows the axial ratio characteristic in the plane ø=0° in the ETC band of the composite antenna according to the second embodiment of the present invention.
Figure 46:
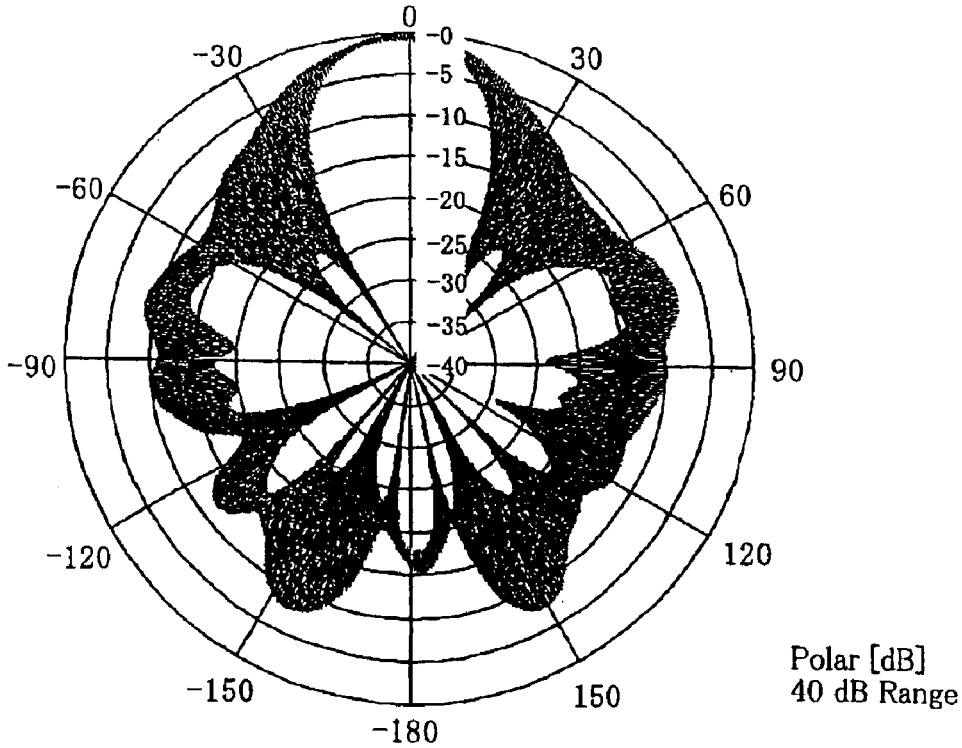
FIG. 46 shows the axial ratio characteristic in the plane ø=90° in the ETC band of the composite antenna according to the second embodiment of the present invention.
Figure 47:
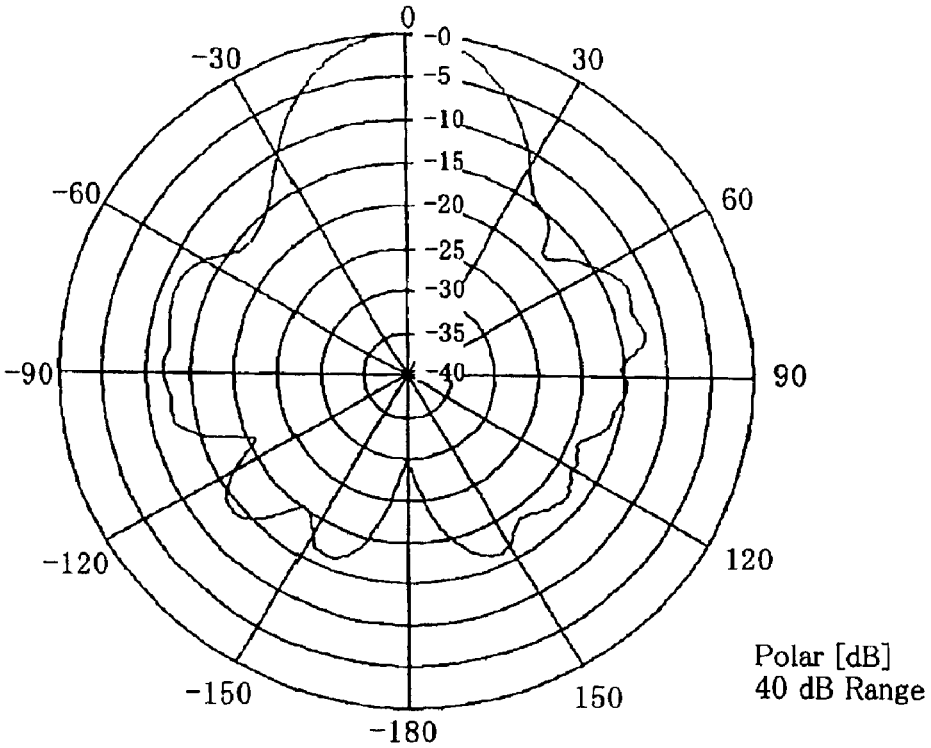
FIG. 47 shows the directional characteristic in the plane ø=0° in the ETC band of the composite antenna according to the second embodiment of the present invention.
Figure 48:
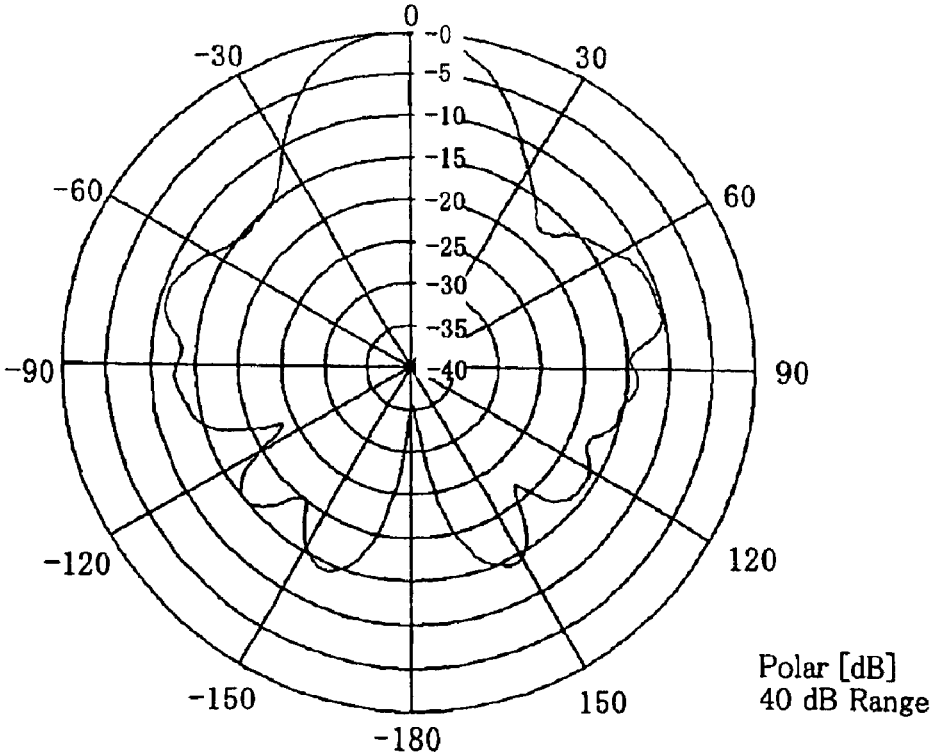
FIG. 48 shows the directional characteristic in the plane ø=90° in the ETC band of the composite antenna according to the second embodiment of the present invention.

FIG. 45 shows the axial ratio characteristic in the plane ø=0° in the ETC frequency band of the second antenna 103. Referring now to FIG. 45, a favorable axial ratio is obtained in a range of approximately ±25° about 0°, and in the ranges of approximately 60° to 80° and approximately −60° to −80°. Further, FIG. 46 shows the axial ratio characteristic in the plane ø=90° in the ETC frequency band of the second antenna 103. Referring now to FIG. 46, a favorable axial ratio is obtained in a range of approximately ±25° about 0°, and in the ranges of approximately 60° to 80° and approximately −60° to −80°. Also, FIG. 47 shows the directional characteristic (ETC band) in the plane ø=0° for right-handed polarized waves of the second antenna 103. Referring now to FIG. 47, a favorable directional characteristic within −10 dB is obtained in the range 30° to −30°. Furthermore, FIG. 48 shows the directional characteristic (ETC band) in the plane ø=90° for right-handed polarized waves of the second antenna 103. Referring now to FIG. 48, a favorable directional characteristic within −10 dB in the range 30° to −30° is obtained. Referring now to FIGS. 45 to 48, the second antenna 103 is afforded favorable antenna characteristics in the zenith direction. However, because radio waves arrive from the zenith direction in ETC, the antenna characteristics may be said to be sufficient.

Figure 49:
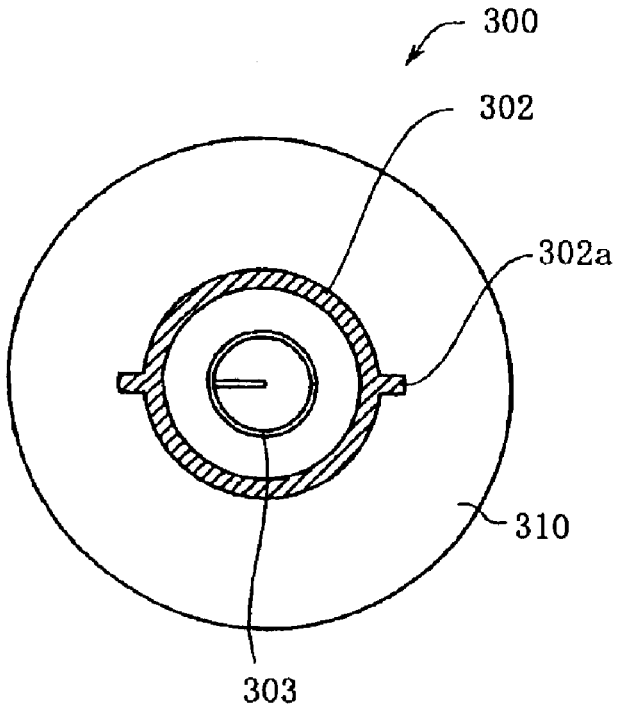
FIG. 49 is a planar view of the constitution of the composite antenna according to a fourth embodiment of the present invention.
Figure 50:
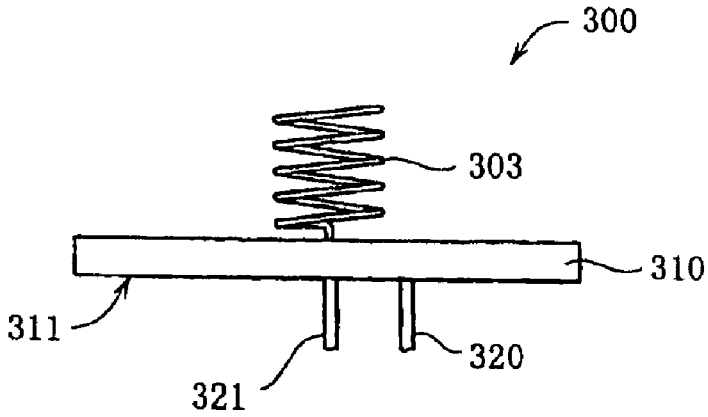
FIG. 50 is a side view of the constitution of the composite antenna according to the fourth embodiment of the present invention.

Next, the constitution of the composite antenna according to the fourth embodiment of the present invention is shown in FIGS. 49 and 50, where FIG. 49 is a planar view of a fourth composite antenna 300 according to the present invention, and FIG. 50 is a side view thereof.

The fourth composite antenna 300 shown in FIGS. 49 to 50 is a two-frequency composite antenna and is constituted to operate as a 5.8 GHz-band DSRC antenna for ETC or similar and as a 1.5 GHz-band GPS antenna, for example. A GPS loop antenna 302 is formed by a print pattern in the upper surface of a circular dielectric substrate 310 which constitutes the composite antenna 300. The loop antenna 302 is constituted as a circularly polarized antenna as a result of being formed having a pair of perturbation elements 302*a* that lie opposite each other in an outward direction. Further, an earth pattern 311 is formed over the whole of the underside of the dielectric substrate 310.

Further, an ETC helical antenna 303 is disposed substantially in the center of the upper surface of the dielectric substrate 310. In such a composite antenna 300, the loop antenna 302 is constituted to operate as a right-handed circularly polarized antenna as a result of electricity being supplied from an arc-shaped feed pattern (not shown) which is disposed so as to be electromagnetically coupled to this loop antenna. This feed pattern is disposed so as to be embedded as described earlier within the dielectric substrate 310. A first feed line 320 is connected to this feed pattern such that the loop antenna 302 is constituted to operate as a right-handed circularly polarized antenna. Further, the helical antenna 303 is constituted by winding wire material in the form of a helix in the direction in which the right-handed circularly polarized antenna operates, and electricity is supplied to this helical antenna from a second feed line 321.

The fourth composite antenna 300 according to the present invention comprises a right-handed polarized wave loop antenna 302 that operates in the GPS band and which is formed on the dielectric substrate 310. Because this antenna is a loop antenna, the space therein can be utilized. Therefore, in the case of the fourth composite antenna 300 according to the present invention, the helical antenna 303 which operates in the ETC frequency band is disposed in the space in the loop antenna 302 so as to lie on substantially the same axis as the loop antenna 302. A small composite antenna which is capable of operating in two different frequency bands can accordingly be obtained, and the mount area for the composite antenna 300 can be reduced and handling thereof facilitated.

Figure 51:
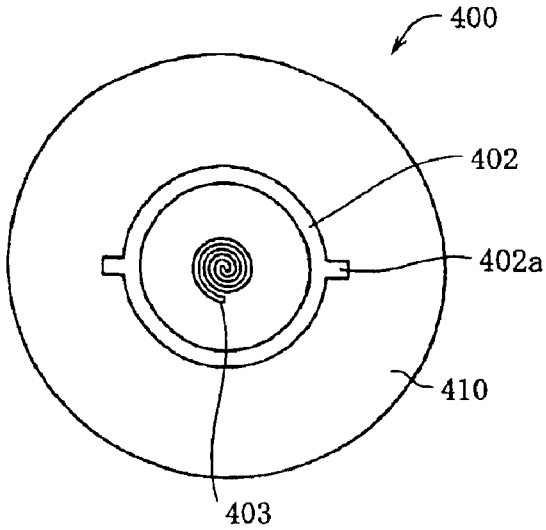
FIG. 51(*a*) is a planar view showing the constitution of a modified example of the composite antenna according to the first embodiment of the present invention.
Figure 51:
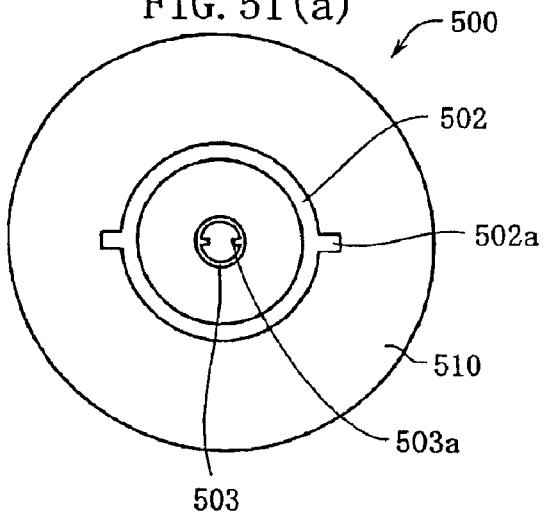
Figure 51:
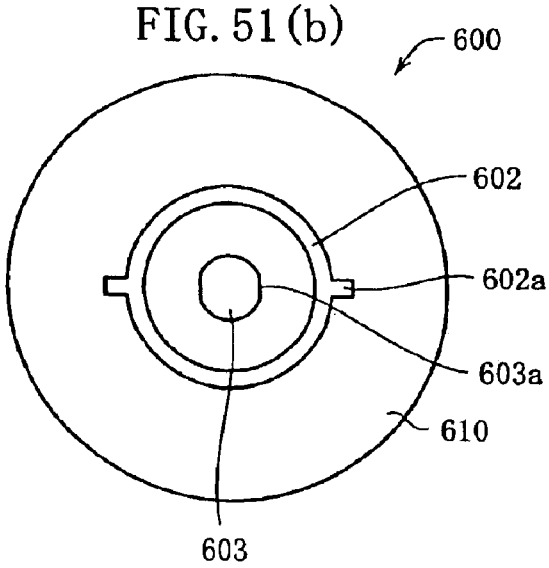

Next, modified examples of the above-described first to third composite antennae 1 to 200 according to the present invention are shown in FIGS. 51(*a*), 51(*b*) and 51(*c*). Further, FIGS. 51(*a*), 51(*b*) and 51(*c*) are planar views of the modified examples of the composite antennae according to the present invention.

The modified example of a composite antenna shown in FIG. 51(*a*) is a two-frequency composite antenna 400 which is constituted to operate as a 5.8 GHz-band DSRC antenna for ETC or similar and as a 1.5 GHz-band GPS antenna, for example. A GPS loop antenna 402 is formed by a print pattern in the upper surface of a dielectric substrate 410 which constitutes the composite antenna 400. The loop antenna 402 is constituted as a circularly polarized loop antenna as a result of being formed having a pair of perturbation elements 402*a* that lie opposite each other in an outward direction. Further, an earth pattern is formed over the whole of the underside of the dielectric substrate 410. A spiral antenna 403 that operates in the DSRC frequency band is formed by a print pattern substantially in the center of the loop antenna 402. In the case of the composite antenna 400, because the spiral antenna 403 which operates in the ETC frequency band is constituted within the loop antenna 402, which operates in the GPS band and is formed on the dielectric substrate 410, so as to lie on substantially the same axis as the loop antenna 402, a small composite antenna which is capable of operating in two different frequency bands can accordingly be obtained.

The modified example of a composite antenna shown in FIG. 51(*b*) is a two-frequency composite antenna 500 which is constituted to operate as a 5.8 GHz-band DSRC antenna for ETC or similar and as a 1.5 GHz-band GPS antenna, for example. A GPS first loop antenna 502 is formed by a print pattern in the upper surface of a dielectric substrate 510 which constitutes the composite antenna 500. The first loop antenna 502 is constituted as a circularly polarized loop antenna as a result of being formed having a pair of first perturbation elements 502*a* that lie opposite each other in an outward direction. Further, an earth pattern is formed over the whole of the underside of the dielectric substrate 510. A second loop antenna 503 that operates in the DSRC frequency band is formed by a print pattern substantially in the center of the first loop antenna 502. The second loop antenna 503 is constituted as a circularly polarized loop antenna as a result of being formed having a pair of second perturbation elements 503*a* that lie opposite each other in an outward direction. In the case of the composite antenna 500, because the second loop antenna 503 which operates in the ETC frequency band is constituted within the first loop antenna 502, which operates in the GPS band and is formed on the dielectric substrate 510, so as to lie on substantially the same axis as the first loop antenna 502, a small composite antenna which is capable of operating in two different frequency bands can accordingly be obtained.

The modified example of a composite antenna shown in FIG. 51(*c*) is a two-frequency composite antenna 600 which is constituted to operate as a 5.8 GHz-band DSRC antenna for ETC or similar and as a 1.5 GHz-band GPS antenna, for example. A GPS loop antenna 602 is formed by a print pattern in the upper surface of a dielectric substrate 610 which constitutes the composite antenna 600. The loop antenna 602 is constituted as a circularly polarized loop antenna as a result of being formed having a pair of perturbation elements 602*a* that lie opposite each other in an outward direction. Further, an earth pattern is formed over the whole of the underside of the dielectric substrate 610. A circular patch antenna 603 that operates in the DSRC frequency band is formed by a print pattern substantially in the center of the loop antenna 602. The circular patch antenna 603 is constituted as a circularly polarized patch antenna by forming a pair of opposing degeneracy isolation elements 603*a* on this antenna. In the case of the composite antenna 600, because the circular patch antenna 603 which operates in the ETC frequency band is constituted within the loop antenna 602, which operates in the GPS band and is formed on the dielectric substrate 610, so as to lie on substantially the same axis as the loop antenna 602, a small composite antenna which is capable of operating in two different frequency bands can accordingly be obtained.

In the composite antenna according to the present invention described hereinabove, the shape of the dielectric substrate is described as circular. However, the present invention is not limited to or by such a shape, and can be implemented with a multi-sided shape such as a triangle, a rectangle, a hexagon, or an octagon.

Furthermore, in the above description, the composite antenna according to the present invention was constituted to operate as a 5.8 GHz-band DSRC antenna and as a 1.5 GHz-band GPS antenna but is not limited to such a constitution. The outer loop antenna could be a GPS antenna and the inner antenna a 2.5 GHz-band VICS (radio wave beacon) antenna, and the outer loop antenna could be a 2.5 GHz-band VICS (radio wave beacon) antenna and the inner antenna a 5.8 GHz-band DSRC antenna. Moreover, in addition to a GPS system, a DSRC system, and a VICS system and so forth, the composite antenna according to the present invention can be applied as an antenna for a plurality of systems among systems that include satellite communication systems, vehicle telephone systems, and satellite radio systems.

INDUSTRIAL APPLICABILITY

As described above, because, according to the present invention, a loop antenna which operates in a second frequency band is formed on a dielectric substrate so as to surround a patch antenna which operates in a first frequency band, a small composite antenna which operates in two different frequency bands can be obtained. Accordingly, because, according to the present invention, a space in the loop antenna which operates in the second frequency band is used to form a patch antenna which operates in the first frequency band, a small composite antenna can be obtained, and the mount area thereof can be reduced and handling thereof facilitated.

Moreover, because the loop antenna and the patch antenna are provided on substantially the same axis, it is possible to inhibit the mutual influence of the antennae. In addition, when the patch antenna is provided with degeneracy isolation elements, a DSRC circularly polarized antenna for ETC and the like can be implemented, and, by providing the loop antenna with perturbation elements to constitute a circularly polarized antenna, a GPS antenna can be produced.

What is claimed is:

1. A composite antenna, characterized by comprising:

a patch antenna which operates in a first frequency band and which is formed substantially in the center of a dielectric substrate; and a loop antenna which operates in a second frequency band that is lower than the first frequency band and which is formed on the dielectric substrate so as to surround the patch antenna, characterized in that a first earth pattern for the loop antenna is formed in the underside of the dielectric substrate, a recess being formed substantially in the center thereof; and a pattern formed in the bottom face of the recess constitutes a second earth pattern for the patch antenna.

2. The composite antenna according to claim 1, characterized in that the patch antenna and the loop antenna are formed on substantially the same axis; the patch antenna is constituted as a circularly polarized antenna by forming a pair of opposing degeneracy isolation elements on the patch antenna; and the loop antenna is constituted as a circularly polarized antenna by forming a pair of opposing perturbation elements on the loop antenna.

3. The composite antenna according to claim 1, characterized in that:

the dielectric substrate is formed by combining a plurality of print substrates, respective patterns for the patch antenna and the loop antenna being formed in the upper surface of a print substrate that lies uppermost, the second earth pattern being formed in the underside of this substrate so as to lie opposite the patch antenna;

a through-hole for the formation of the recess is formed substantially in the center of an intermediate print substrate, a feed pattern which is electromagnetically coupled to the loop antenna being formed in the upper surface of the intermediate print substrate; and a through-hold for the formation of the recess is formed substantially in the center of a print substrate that lies lowermost, the first earth pattern being formed in the underside of this substrate.

4. The composite antenna according to claim 1, characterized in that a pattern that connects the second earth pattern and the first earth pattern is formed in the circumferential wall face of the recess.

5. The composite antenna according to claim 1, characterized in that a second loop antenna which operates in the first frequency band and which comprises perturbation elements is formed in place of the patch antenna.

6. The composite antenna according to claim 2, characterized in that a second loop antenna which operates in the first frequency band and which comprises perturbation elements is formed in place of the patch antenna.

7. The composite antenna according to claim 3, characterized in that a second loop antenna which operates in the first frequency band and which comprises perturbation elements is formed in place of the patch antenna.

8. The composite antenna according to claim 4, characterized in that a second loop antenna which operates in the first frequency band and which comprises perturbation elements is formed in place of the patch antenna.

9. The composite antenna according to claim 1, characterized in that a spiral antenna which operates in the first frequency band is formed in place of the patch antenna.

10. The composite antenna according to claim 2, characterized in that a spiral antenna which operates in the first frequency band is formed in place of the patch antenna.

11. The composite antenna according to claim 3, characterized in that a spiral antenna which operates in the first frequency band is formed in place of the patch antenna.

12. The composite antenna according to claim 4, characterized in that a spiral antenna which operates in the first frequency band is formed in place of the patch antenna.

13. A composite antenna, characterized by comprising:

a patch antenna which operates in a first frequency band and which is formed in the bottom face of a recess provided substantially in the center of a dielectric substrate; and a loop antenna which operates in a second frequency band that is lower than the first frequency band and which is formed on the dielectric substrate so as to surround the patch antenna, characterized in that an earth pattern is formed in the underside of the dielectric substrate.

14. The composite antenna according to claim 13, characterized in that the patch antenna and the loop antenna are formed on substantially the same axis; the patch antenna is constituted as a circularly polarized antenna by forming a pair of opposing degeneracy isolation elements on the patch antenna; and the loop antenna is constituted as a circularly polarized antenna by forming a pair of opposing perturbation elements on the loop antenna.

15. The composite antenna according to claim 13, characterized in that:

the dielectric substrate is formed by combining a plurality of print substrates;

a through-hole for the formation of the recess is formed substantially in the center of a print substrate that lies uppermost, a pattern for the loop antenna being formed in the upper surface of this substrate;

a through-hole for the formation of the recess is formed substantially in the center of an intermediate print substrate, a feed pattern which is electromagnetically coupled to the loop antenna being formed in the upper surface of the intermediate print substrate; and a pattern for the patch antenna is formed in the upper surface of a print substrate that lies lowermost, the earth pattern being formed in the underside of this substrate.

16. The composite antenna according to claim 13, characterized in that a second loop antenna which operates in the first frequency band and which comprises perturbation elements is formed in place of the patch antenna.

17. The composite antenna according to claim 14, characterized in that a second loop antenna which operates in the first frequency band and which comprises perturbation elements is formed in place of the patch antenna.

18. The composite antenna according to claim 15, characterized in that a second loop antenna which operates in the first frequency band and which comprises perturbation elements is formed in place of the patch antenna.

19. The composite antenna according to claim 13, characterized in that a spiral antenna which operates in the first frequency band is formed in place of the patch antenna.

20. The composite antenna according to claim 14, characterized in that a spiral antenna which operates in the first frequency band is formed in place of the patch antenna.

21. The composite antenna according to claim 15, characterized in that a spiral antenna which operates in the first frequency band is formed in place of the patch antenna.

22. A composite antenna, characterized by comprising:

a patch antenna which operates in a first frequency band and which is formed in the bottom face of a first recess provided substantially in the center of a dielectric substrate; and a loop antenna which operates in a second frequency band that is lower than the first frequency band and which is formed on the dielectric substrate so as to surround the patch antenna, characterized in that a first earth pattern for the loop antenna is formed in the underside of the dielectric substrate, a second recess being formed substantially in the center thereof; and a pattern formed in the bottom face of the second recess constitutes a second earth pattern for the patch antenna.

23. The composite antenna according to claim 22, characterized in that the patch antenna and the loop antenna are formed on substantially the same axis; the patch antenna is constituted as a circularly polarized antenna by forming a pair of opposing degeneracy isolation elements on the patch antenna; and the loop antenna is constituted as a circularly polarized antenna by forming a pair of opposing perturbation elements on the loop antenna.

24. The antenna according to claim 22, characterized in that:

the dielectric substrate is formed by combining a plurality of print substrates; a through-hole for the formation of the first recess is formed substantially in the center of a print substrate that lies uppermost, a pattern for the loop antenna being formed in the upper surface of this substrate;

a through-hole for the formation of the first recess is formed substantially in the center of a first intermediate print substrate, a feed pattern which is electromagnetically coupled to the loop antenna being formed in the upper surface of the first intermediate print substrate;

a pattern for the patch antenna is formed in the upper surface of a second intermediate print substrate, the second earth pattern being formed in the underside of this substrate so as to lie opposite the patch antenna; and a through-hole for the formation of the second recess is formed substantially in the center of a print substrate that lies lowermost, the first earth pattern being formed in the underside of this substrate.

25. The composite antenna according to claim 22, characterized in that a pattern that connects the second earth pattern and the first earth pattern is formed in the circumferential wall face of the second recess.

26. The composite antenna according to claim 22, characterized in that a second loop antenna which operates in the first frequency band and which comprises perturbation elements is formed in place of the patch antenna.

27. The composite antenna according to claim 23, characterized in that a second loop antenna which operates in the first frequency band and which comprises perturbation elements is formed in place of the patch antenna.

28. The composite antenna according to claim 24, characterized in that a second loop antenna which operates in the first frequency band and which comprises perturbation elements is formed in place of the patch antenna.

29. The composite antenna according to claim 25, characterized in that a second loop antenna which operates in the first frequency band and which comprises perturbation elements is formed in place of the patch antenna.

30. The composite antenna according to claim 22, characterized in that a spiral antenna which operates in the first frequency band is formed in place of the patch antenna.

31. The composite antenna according to claim 23, characterized in that a spiral antenna which operates in the first frequency band is formed in place of the patch antenna.

32. The composite antenna according to claim 24, characterized in that a spiral antenna which operates in the first frequency band is formed in place of the patch antenna.

33. The composite antenna according to claim 25, characterized in that a spiral antenna which operates in the first frequency band is formed in place of the patch antenna.

* * * * *